US012595930B2

(12) United States Patent
Lehnert et al.

(10) Patent No.: US 12,595,930 B2
(45) Date of Patent: Apr. 7, 2026

(54) HVAC SYSTEM AND RELATED METHODS

(71) Applicant: BELIMO Holding AG, Hinwil (CH)

(72) Inventors: Frank Lehnert, Rüti (CH); Urs Niederhauser, Pfungen (CH); Volkher Scholz, Zürich (CH); Reto Wälchli, Zürich (CH); Christoph Neukom, Volketswil (CH); Christoph Rebsamen, Stäfa (CH)

(73) Assignee: BELIMO Holding AG, Hinwil (CH)

( * ) Notice: Subject to any disclaimer, the term of this patent is extended or adjusted under 35 U.S.C. 154(b) by 251 days.

(21) Appl. No.: 18/254,662

(22) PCT Filed: Nov. 25, 2021

(86) PCT No.: PCT/EP2021/082997
§ 371 (c)(1),
(2) Date: May 26, 2023

(87) PCT Pub. No.: WO2022/112415
PCT Pub. Date: Jun. 2, 2022

(65) Prior Publication Data

US 2024/0230140 A1 Jul. 11, 2024

(30) Foreign Application Priority Data

Nov. 26, 2020 (EP) ..... 20210098

(51) Int. Cl.
*F24F 11/84* (2018.01)
*F24F 11/32* (2018.01)

(52) U.S. Cl.
CPC ..... *F24F 11/84* (2018.01); *F24F 11/32* (2018.01)

(58) Field of Classification Search
CPC ..... F24F 13/08; F24F 13/10; F24F 2140/40
See application file for complete search history.

(56) References Cited

U.S. PATENT DOCUMENTS 5,446,677 A * 8/1995 Jensen ..... F24F 11/74 236/49.5
10,620,616 B2 * 4/2020 Goldschmidt ..... F24F 11/74
2013/0324027 A1 * 12/2013 Davis ..... F24F 11/30 454/258

(Continued)

FOREIGN PATENT DOCUMENTS

EP 3 246 504 A2 11/2017
EP 3 620 872 A1 3/2020
WO 99/39430 A1 8/1999

OTHER PUBLICATIONS

European Search Report corresponding to 20210098.8 mailed Jul. 27, 2021.

(Continued)

*Primary Examiner* — Nelson J Nieves
(74) *Attorney, Agent, or Firm* — Finch & Maloney PLLC

(57) ABSTRACT

A method of controlling an HVAC system (10) that comprises least one flow regulator (16), an electromechanical actuator (20), one or more sensors (34) associated with the actuator, and a controller (32) operatively connected with the actuator and with the sensors. The method includes the steps of actuating the flow regulator, receiving signals from the sensors, and determining an actual or forthcoming malfunction based on the signals. It is determined whether the malfunction is in the actuator or the flow regulator.

20 Claims, 16 Drawing Sheets

(56) References Cited

U.S. PATENT DOCUMENTS

| | | | | |
|---|---|---|---|---|
| 2014/0277773 | A1* | 9/2014 | Goldschmidt | G05B 13/026 700/282 |
| 2016/0116177 | A1* | 4/2016 | Sikora | F24F 11/64 165/250 |
| 2016/0131381 | A1* | 5/2016 | Schmidlin | F24F 11/80 700/277 |
| 2017/0268797 | A1* | 9/2017 | Mowris | F24H 9/2064 |
| 2017/0293293 | A1* | 10/2017 | Brownie | G05B 23/0275 |
| 2019/0162436 | A1 | 5/2019 | Albinger et al. | |
| 2020/0004231 | A1* | 1/2020 | Anderson | F24H 15/36 |
| 2020/0363087 | A1* | 11/2020 | Mowris | F24F 11/74 |
| 2021/0231322 | A1* | 7/2021 | Han | F24F 8/90 |
| 2021/0270481 | A1* | 9/2021 | Koop | A62C 2/241 |
| 2021/0270492 | A1* | 9/2021 | Koop | F24F 13/075 |

OTHER PUBLICATIONS

International Search Report Corresponding to PCT/EP2021/082997 mailed Mar. 3, 2022.

Written Opinion Corresponding to PCT/EP2021/082997 mailed Mar. 3, 2022.

* cited by examiner

80

| | | Actuator Factors | | Flow Regulator Factors | |
|---|---|---|---|---|---|
| | | Worn Motor Bearing | | Broken Valve Flap | |
| Load (Torque) | Angular Range 0-5° (84) | Slightly increased | ↗ | No influence | → |
| Load (Torque) | Angular Range 5-20° (86) | Slightly increased | ↗ | Changed | ✥ |
| Load (Torque) | Angular Range 20-85° (88) | Over limit | ↑ | No influence | → |
| Load (Torque) | Stored Spring Energy | Increased | ↗ | No influence | → |
| Load (Torque) | Standard Deviation (90) | Increased | ↗ | No influence | → |
| Load (Torque) | Integral of Seal Peak (94) | Increased | ↗ | Changed | ✥ |
| Time Travel | Full Travel Range | (Full travel not reached) | → | Changed | ✥ |
| Time Travel | Return Time (98, 96) | Increased | ↗ | No influence | → |
| | | Check/ Replace Actuator | | Check/ Repair Flap | |

Fig. 11

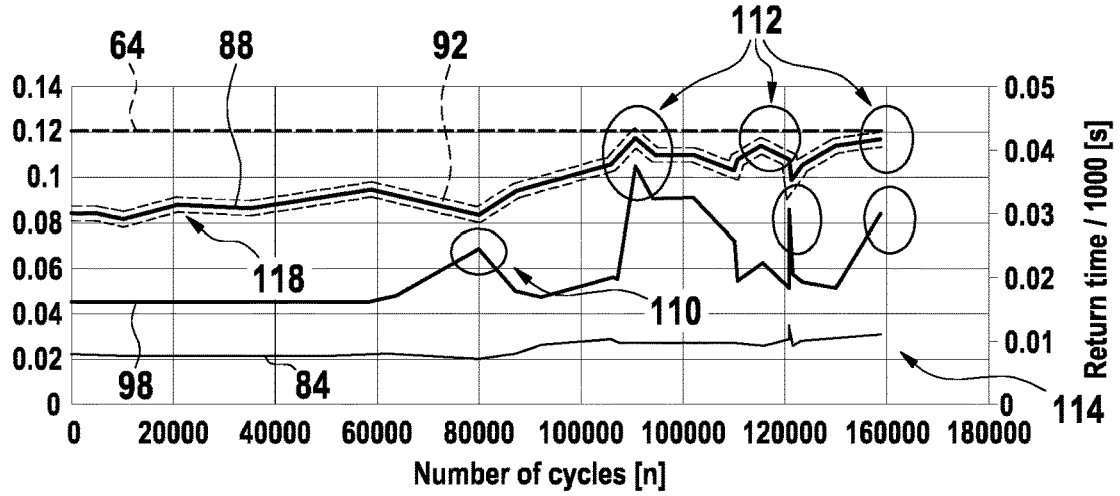

Fig. 12

HVAC SYSTEM AND RELATED METHODS

FIELD OF THE DISCLOSURE

The present disclosure relates to the field of HVAC (Heating, Ventilation, Air Conditioning) systems, and in particular to diagnosing operation of electronically controlled flow regulators within HVAC systems.

BACKGROUND TO THE DISCLOSURE

HVAC systems installed in buildings or other installations are expected to achieve high standards of safety and reliability. HVAC systems also contribute to a building's fire safety. Monitoring and testing of the system is important for maintaining reliability and safety standards. Laws often require regular checks to be carried out on the system's performance.

One aspect of monitoring and testing a HVAC system concerns the functionality of electronically controlled flow regulators, e.g. valves and dampers, that regulate flow of fluids (gases and/or liquids, such as air and/or water). The efficiency and safety of the system may depend on the regulators functioning correctly. Fire dampers are examples of electronically controlled regulators intended to close off air passages in the HVAC system in the event of a fire, to avoid fire and smoke spreading in a building via the HVAC system. Smoke control dampers are examples of electronically controlled regulators similarly intended to open to allow extraction of smoke and fumes through a ventilation duct. Testing can verify whether such dampers do function as required, close tightly and open properly. Other electronically controlled regulators are also important to everyday ventilation, heating and air conditioning.

When a malfunction occurs in a HVAC flow regulator, diagnosing the cause is complicated, especially when the regulator is assembled from multiple operating parts or units that interact, such as flow-controlling parts in the fluid path, electro-mechanical parts, and operating sensors. Since different component units of the regulator are often the responsibility of, or need the skills of, different specialists, corrective action can only be carried out once it is determined properly where the fault lies. The problem is further exacerbated if the electronically controlled flow regulators are placed in locations making physical access to the regulators difficult, which is not infrequent.

If checks are carried out relatively infrequently (for example, every 6 or 12 months), a malfunction may occur that is not detectable for a long time, potentially creating a hidden safety hazard. In addition to solving problems for regulators that have malfunctioned, a further technical challenge relates to identifying electronically controlled regulators that present risk of failing in the future. Diagnosing potential future faults, and associated causes for the potential faults, especially in regulators constructed from multiple component units, adds further technical complexity.

It would be desirable to address and/or mitigate one or more of the issues described above.

SUMMARY OF THE DISCLOSURE

Aspects of the disclosure are identified in the claims.

A first aspect of the invention provides a method of controlling an HVAC system comprising:

at least one flow regulator comprising an actuatable element for regulating fluid flow in a fluid path;

an electro-mechanical actuator associated with the flow regulator, to actuate the fluid flow regulator, wherein the actuator comprises an electric motor driving a movable output member;

one or more sensors associated with each actuator, wherein the sensors are chosen from the group consisting of load sensors, force sensors, torque sensors, current sensors, voltage sensors, power sensors, speed sensors and position sensors;

a controller operatively connected with the actuator and the sensor(s);

wherein the method comprises the steps of:

i. actuating the flow regulator;

ii. receiving signals from the one or more sensors;

iii. determining an actual or forthcoming malfunction, based on the signals received in step ii.;

iv. indicating said actual or forthcoming malfunction to an operator of said HVAC system;

characterized in that it is distinguished in step iv. between an actual or forthcoming malfunction of:

the actuator; and the flow regulator.

Such a method permits self-diagnosis of the malfunction (actual or forthcoming) by the controller. By distinguishing between a malfunction of the actuator or the flow regulator, the task of corrective action to repair or mitigate the malfunction is made much easier. Depending on whether the fault is caused by the flow regulator, or by the actuator, the appropriate specialist (e.g. a person and/or a machine and/or a robot) for the respective unit can repair, replace, or perform other maintenance on the appropriate unit, and/or record the fault in appropriate technical documentation.

This may be especially, but not exclusively, useful when the flow regulator and the actuator operate together as an integrated unit, but originate from different manufacturers, for example, in an OEM (Original Equipment Manufacturer) production process. The flow regulator and the actuator may then be the responsibility of, or need the skills of, different specialists after manufacture.

The ability to self-diagnose actual and forthcoming malfunctions can contribute significantly to the safety (e.g. fire safety) of a building in which the HVAC system is installed. The performance of the actuator and the flow regulator can be monitored as frequently as desired, e.g. in parallel with normal operation in some embodiments. Also, a forthcoming malfunction can be diagnosed and remediated in advance. A forthcoming malfunction may be a predicted malfunction, for example, corresponding to increased risk or likelihood that malfunction may occur even though the actuator and/or the flow regulator remain functioning at the time of diagnosis. Detection of a forthcoming malfunction is significant for enabling predictive maintenance adapted to the individual actuator and/or flow regulator, and which may supplement or be used instead of just a regular maintenance schedule.

A yet further advantage of self-diagnosis is that it may provide an operator with important information as to whether the HVAC system is correctly set-up and/or dimensioned. For example, the information may enable the operator to optimise the HVAC system towards better cost structure and/or desired reliability.

As used herein, the term flow regulator may be any device for adjusting an orifice to regulate fluid flow in a flow path, for example, a damper, a flap, or a valve. The flow regulator may be of type having two discrete states, for example, open and closed; or the flow regulator may of a type having three or more discrete states, for example, open, closed and one or more intermediate states; or the flow regulator may be of a type that defines a continuously variable orifice size, for example continuously variable between fully open and fully closed. The actuatable part of the flow regulator may, for example, be any movable element such as a damper blade, a valve ball, valve plug, valve flap, etc.

In some embodiments, a lever mechanism may operatively connect the output member of the actuator, and the flow regulator. Other types of mechanisms, or direct or indirect couplings between the actuator and the flow regulator may alternatively be used, as desired.

In some embodiments, the actual or forthcoming malfunction of the flow regulator is chosen from a group comprising, preferably consisting of, a worn-out bearing; a deficiently fixed bearing; a worn-out gasket; a distorted damper sleeve; a broken damper blade; blockage of the actuatable part of the flow regulator, for example, caused by a foreign object or caused by excessive contamination of, or excessive pollution of, the medium in the flow path.

Additionally or alternatively, in some embodiments, the actual or forthcoming malfunction of the actuator is chosen from a group comprising, preferably consisting of, a defective or worn out bearing for the output member; defective or worn out output gearing; defective actuator mounting; defective motor; defective motor bearing; defective connection to the flow regulator; non-attached connection to the flow regulator; defective return spring; defective supercapacitor for powering actuation to a predetermined position in the event of power loss; defective battery for powering actuation to a predetermined position in the event of power loss; defective electronic circuitry.

By way of example, a non-attached connection state with respect to the flow regulator may occur if the actuator and flow regulator are incorrectly assembled during manufacture or installation. Detecting such a malfunction may be important when the flow regulator and the actuator are integrated in an HVAC system, as described later. A non-attached connection state may be diagnosed by defining a predetermined travel range of movement for the flow regulator, and monitoring whether the flow-regulator in use realises the travel range and/or whether the actuator measures movement beyond the travel range. The travel range may be sensed by, for example, one or more position sensors, or end-stop sensors, or monitoring other parameters such as load or current when the flow regulator is actuated to reach an end-stop position. In one example, the flow regulator may be mechanically restricted (e.g. by end-stops) to a travel range of 0° to 90°. Should the actuator measure, from the output member, an angle outside the restricted range (e.g. less than 0° or more than 90°), this may indicate that output member of the actuator is not attached operatively to the flow regulator. It is also possible to determine the travel range of the flow regular indirectly, for example, by: (i) determining an angular distance the motor has travelled (e.g. be means of a position sensor or, sensorless deduction by the motor controller); and (ii) calculating the corresponding travel range of the flow regulator using a known gear ratio.

In addition to the sensors associated with the actuator, in some embodiments, the HVAC system further comprises one or more sensors chosen from the group comprising, preferably consisting of, temperature sensors; humidity sensors; flow sensors; air speed sensors; air/fluid quality/pollution sensors; viscosity sensors; concentration sensors; optical sensors (for example, CCD sensors or cameras). By way of example, optical sensors may monitor the operating state and/or condition of the flow regulator, and/or may monitor pollution and/or contamination of the medium in the flow path).

Such sensors can provide additional information to the controller relating to temporal parameters that may influence operation characteristics of the flow regulator and/or the actuator. For example, temperature and/or pressure and/or fluid contamination can influence the manner in which the regulator operates. Providing such information to the controller may facilitate the controller compensating for such parameter variations in determining an actual or forthcoming malfunction.

Additionally or alternatively, in some embodiments, in step iii., the actual or forthcoming malfunction is determined while taking into account as a corrective compensation:

- the flow rate of the medium through the flow regulator; or
- the temperature at which the actuator is operating, preferably the temperature of the motor of the actuator; or
- the temperature of the fluid in the flow path of the flow regulator or
- history of actuator torques and/or actuator temperatures; and combinations thereof.

Additionally or alternatively, in some embodiments, historical information may be recorded to judge a service age of the flow regulator and/or the actuator. For example, in some embodiments, the cycle number and/or the count of direction changes and/or the aggregate operating time and/or the aggregate travel of the flow regulator; and/or the cycle number and/or the count of direction changes and/or the aggregate operating time and/or the aggregate travel of the actuator is recorded.

A variety of techniques may be used to determine and discriminate actual and forthcoming malfunctions.

In some embodiments, in step iii.

- a reference torque curve or current curve of the actuator per se without the flow regulator; and/or
- a reference curve associated with the flow regulator per se without the actuator; and/or
- a reference torque curve or current curve of the actuator when operatively connected with the flow regulator;

is used to determine an actual or forthcoming malfunctioning.

Use of a reference torque curve or current curve of the actuator per se without the flow regulator can provide useful baseline information to the controller about the characteristics of just the actuator without any influence of the flow regulator. This may facilitate identifying and discriminating malfunctions (actual and/or forthcoming) associated with the actuator.

Similarly, use of a reference curve associated with the flow regulator per se without the actuator can provide useful baseline information to the controller about the characteristics of the just the flow regulator without any influence of the actuator. This may facilitate identifying and discrimination malfunctions (actual and/or forthcoming) associated with the flow regulator.

Similarly, a reference torque curve or current curve of the actuator when operatively connected with the flow regulator provides baseline information of how both units perform together, which is the operating condition that will normally be evaluated by the method.

Additionally or alternatively, in some embodiments, in step ii.

- the torque profile and/or the current profile while the flow regulator is being actuated or actuation is being released; and/or the position of the output member over time while the flow regulator is either being actuated or actuation is being released; and/or an integral calculated from the torque profile and/or the current profile while the flow regulator is being actuated or actuation is being released; and/or the position of the output member at a maximum torque magnitude and/or at a maximum current magnitude and/or at a maximum magnitude of calculated derivative of torque and/or at a maximum magnitude of calculated derivative of current; and/or the position of the output member in an open and/or closed position of the flow regulator; and/or the position of the output member at an extremity of a range of travel of the flow regulator; and/or the derivative or torque and/or current when the flow actuator is close to an open and/or closed position; and/or the variance of torque and/or current in a predetermined operating range; and/or the speed of movement of the actuator and/or the flow regulator while the flow regulator is being actuated; and/or return time for a return mechanism to operate in a self-returning valve;

is recorded.

References above to the actuator being released refer to actuators of a type configured, in response to power loss, to move the output member to a predetermined operative position. The predetermined position may, for example, correspond to an open position of the flow regulator, a closed position of the flow regulator, or some intermediate position. Upon power loss, the actuator is said to be being released, and the output member is driven to the predetermined position. For example, the actuator may comprise a spring (e.g. a return spring) to drive movement, or the actuator may comprise a reserve power source, for example, a supercapacitor or a battery, to provide reserve power to perform the actuation.

References above to a derivative refer to performing a mathematical derivative function indicative of rate of change (e.g. a differentiation). References above to an integral refer to performing a mathematical integration function indicative of accumulation or aggregation. References herein to maximum values of parameters or calculations may generally refer to maximum magnitudes in the case where directionality of movement of the actuator and/or flow regulator may introduce negative values as a result of a directional frame of reference.

By way of example, the speed of movement of the actuator and/or the flow regulator during actuation may provide insight into whether the actuator is overloaded. The actuator may operate at a predetermined or expected speed or within a certain speed window, for example, motor rotation of about 2500 RPM. If the actuator deviates from the expected speed by more than a set amount, this may indicate a malfunction, for example, overloading of the actuator for some reason. Speed detection can provide additional or alternative performance information compared to torque/current information. Speed may, for example, be detected or associated with voltage across a motor, or speed may be measured by detecting actuator position changes with respect to time, for example, by counting a rate of generated pulses from a rotation sensor, or by a mathematical derivative of position-related signals.

Also by way of example, detection of the position of the output member at an extremity of a range of movement of the flow regulator, may be used in the detection of a non-attached connection state between the actuator and the flow regulator, as described above. It may also be useful for the detection of abnormal blockage or other obstruction of the actual range of movement of the flow regulator, in use. The position at which the flow regulator stops when the open or closed position is expected, may be used to detect whether the travel range is impeded compared to an expected travel range, for example, should the flow channel be blocked by a foreign object.

Additionally or alternatively, in some embodiments, in step iv., hysteresis of the actuator and/or lever mechanism (if present) is used to distinguish between a malfunctioning of the actuator and the flow regulator. Hysteresis can provide a useful tool for discrimination, because hysteresis is a feature principally of parts other than the flow regulator (namely, for example, the actuator and/or lever mechanism (if present)). The actuator and/or lever mechanism may even be designed to have exaggerated hysteresis, if desired, to provide a greater window for detecting fault parameters associated parts other than the flow regulator.

The controller may optionally be a device that is local to and/or associated uniquely with the respective actuator. For example, the controller may be provided with the actuator, and/or integrated with the actuator, and/or contained within the same housing as the actuator. Such a local controller may optionally be in operative data communication with a system- or group-controller with control for multiple flow regulators.

Alternatively, the first-mentioned controller may be a controller that is operatively connected to and/or in operative communication with respective actuators for multiple flow regulators, for controlling multiple flow regulators according to the method described herein.

A closely related second aspect provides a method of setting-up an HVAC system, optionally for operation according to any of the method steps of the first aspect, the method wherein the HVAC comprises:

at least one flow regulator comprising an actuatable element for regulating fluid flow in a fluid path;

an electro-mechanical actuator associated with the flow regulator, to actuate the flow regulator, wherein the actuator comprises an electric motor driving a movable output member;

one or more sensors associated with each actuator, wherein the sensors are chosen from the group consisting of load sensors, force sensors, torque sensors, current sensors, voltage sensors, power sensors, speed sensors and position sensors;

a controller operatively connected with the actuator and the sensor(s);

wherein the method comprises the steps of:

i. actuating the flow regulator; and/or ii. actuating the actuator per se, without the output member being operatively connected to the flow regulator;

iii. receiving signals from the one or more sensors during step i. and/or ii.;

iv. determining an actual or forthcoming malfunctioning, based on the signals received in step iii.;

v. indicating said actual or forthcoming malfunctioning;

characterized in that it is distinguished in step v. between an actual or forthcoming malfunctioning of:

the actuator; and the flow regulator.

Optionally, the method further comprises step providing user guidance as to how the malfunctioning can be overcome, based on the signals received in step iii.

In any of the above aspects, the method may expressly include diagnosing for a forthcoming malfunction, and/or distinguishing between a forthcoming malfunction and an actual malfunction in the determining and/or indicating steps.

In some embodiments, the step of determining an actual or forthcoming malfunctioning may comprise diagnosing a forthcoming malfunction. Additionally or alternatively, the step of determining an actual or forthcoming malfunction my comprise diagnosing an actual malfunction. Additionally or alternatively, the step of determining an actual or forthcoming malfunction may comprise diagnosing both actual and forthcoming malfunctions (e.g. diagnosing amongst both actual and forthcoming malfunctions).

In some embodiments, the step of determining an actual or forthcoming malfunction comprises:

determining whether the signals received from the one or more sensors correspond to a forthcoming malfunction; and determining whether the signals received from the one or more sensors correspond to an actual malfunction.

Additionally or alternatively, the step of indicating the actual or forthcoming malfunction can comprise distinguishing between an actual malfunction and a forthcoming malfunction.

A closely related third aspect of the disclosure may relate to providing an HVAC flow regulator actuator as a unit that is useful for manufacturers to incorporate into or with an HVAC fluid flow regulator, and optionally provides functionality for any of the methods described above.

Accordingly, a third aspect of the disclosure provides a method comprising:

Obtaining an actuator unit, the actuator unit comprising:

an electro-mechanical actuator comprising an electric motor for driving a movable output member for transmitting mechanical movement from the actuator;

one or more sensors associated with the electro-mechanical actuator, wherein the sensors are chosen from the group consisting of load sensors, force sensors, torque sensors, current sensors, voltage sensors, power sensors, speed sensors and position sensors; and a controller operatively connected with the electro-mechanical actuator and the sensor(s), Assembling the actuator to a flow regulator, the flow regulator comprising an actuatable element for regulating fluid flow in a fluid path in response to movement of the actuator output member; and Operating the controller to register and/or record information about operating characteristics of the actuator operating the flow regulator after assembly, optionally before and/or after installation in an HVAC system, based at least on signals from at least one of the one or more sensors.

With this method, the controller may register information necessary for the controller subsequently to use for determining an actual or forthcoming malfunction. Optionally, the information may facilitate distinguishing between a malfunction (actual or forthcoming) of: the actuator unit; and the flow regulator.

The method may further comprise operating the controller to register and/or record information about operating characteristics of the actuator and the flow regulator before and/or after installation into a HVAC system, based at least on signals from at least one of the one or more sensors. Such a further step, if used, may replace and/or update the information about the operating characteristics of the actuator and the flow regulator, to reflect changes once in situ in the HVAC system.

Preferably, the method may further comprise:

Actuating the flow regulator;

Receiving signals from the one or more sensors;

Determining an actual or forthcoming malfunction based on the signals received from the sensor(s) and, directly or indirectly, on information obtained from the preceding registration step(s), wherein the step of determining comprises distinguishing between an actual or forthcoming malfunction of: the actuator; and the flow regulator.

Although certain features have been highlighted above and in the appended claims, protection is claimed for any novel feature or idea described herein and/or illustrated in the drawings whether or not emphasis has been placed thereon.

BRIEF DESCRIPTION OF THE DRAWINGS

FIG. 11 is a schematic diagram show key performance information, and how the information is used in a diagnosis module to detect malfunctions.

FIG. 12 is a schematic graphical illustration showing a first group of parameters in a first example of flow control device testing.

DETAILED DESCRIPTION OF PREFERRED EMBODIMENTS

Figure 1:
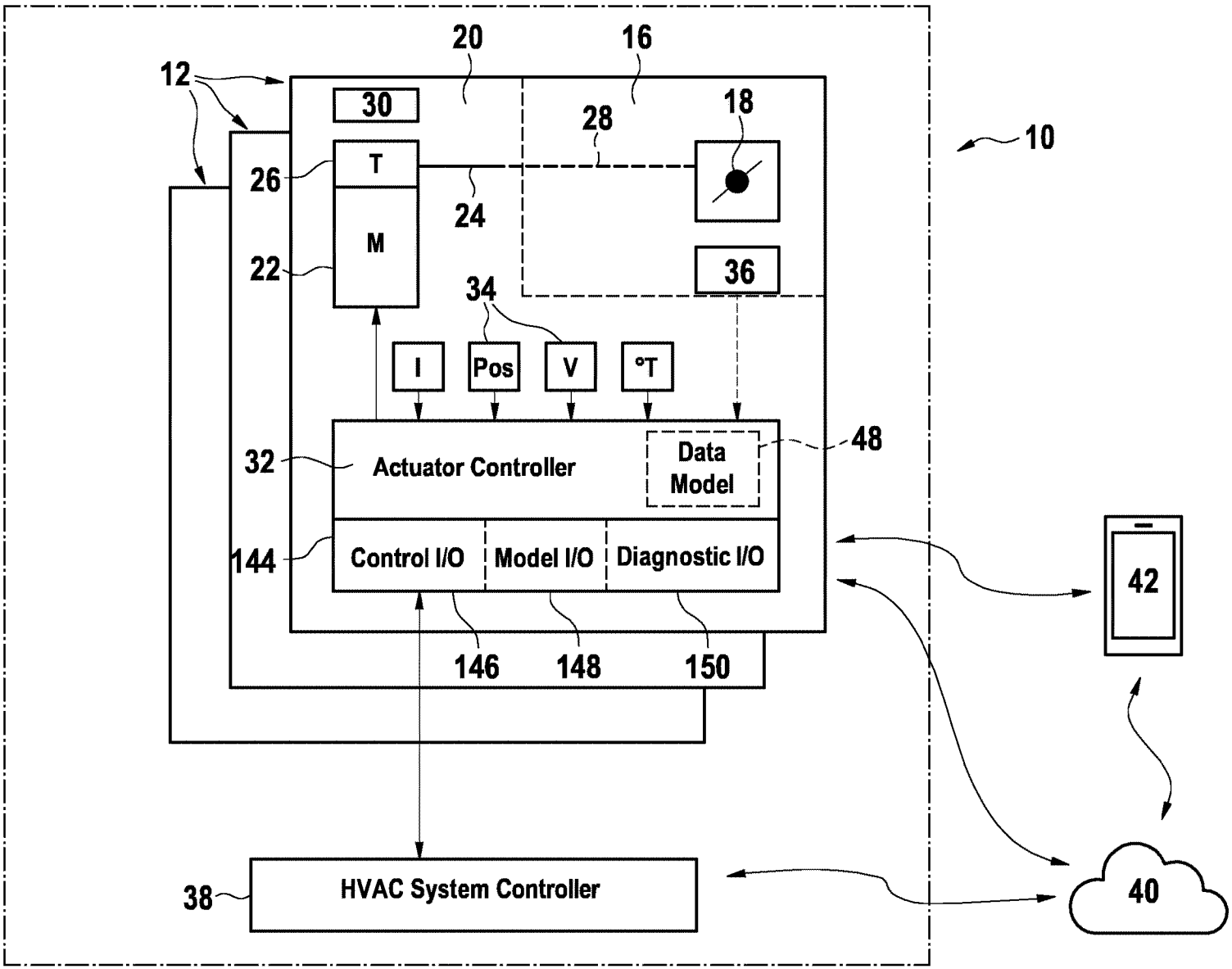
FIG. 1 is a schematic block diagram showing the functional blocks of electronically controlled flow regulators in an HVAC system.

Non-limiting embodiments of the disclosure are now described, by way of example only, with reference to the accompanying drawings. The same reference numerals are used to denote corresponding features, whether or not described in detail.

Referring to FIG. 1, at least one electronically controlled flow control device 12 is shown as part of an HVAC system 10, for controlling fluid flow within a fluid path of the HVAC system. To avoid cluttering the diagram, FIG. 1 does not show the fluid path or other details of the HVAC system 10, only the features relevant to understanding the present disclosure. Preferably, plural devices 12 are provided. The fluid may be liquid and/or gas. Example liquids may include water and/or glycerol. Example gases include air.

In some of the embodiments, the device 12 may be, or is illustrated in the form of, a fire damper. As explained above, a fire damper is a safety device installed in an HVAC ventilation passage. In the event of a fire, the fire damper closes to seal off the passage, and avoid fire and smoke spreading via the HVAC system. However, references herein to fire dampers are merely by way of example, and are to be understood as also extending to other types of fluid control device 12, for example but not limited to, smoke control dampers.

Each device 12 may generally comprise a flow regulator 16. The flow regulator 16 may be any device for adjusting an orifice through which fluid flows, for example, a damper, a flap, a valve, etc. The flow regulator 16 comprises an actuatable element 18 in the fluid path, for example, in the form of one more damper blades, a valve ball, valve plug, valve flap, etc.

Each device 12 may further comprise an electro-mechanical actuator 20 associated with the flow regulator 16 for actuating physical movement of the regulator 16. The actuator 20 may comprise an electric motor 22 or other primary driver driving a movable output member 24 (shown merely schematically in FIG. 1). Optionally, a transmission 26, e.g. a geared transmission, couples a rotor of the motor 22 to the output member 24. In one example, the output member 24 comprises a rotary member that is movable about an axis through a range of about 90°.

The output member 24 is coupled directly or indirectly to the actuatable element 18 of the flow regulator 16. In some embodiments, a lever mechanism 28 operatively links the output member 24 to the actuatable member 18, but other types of mechanism, or direct or indirect couplings may alternatively be used as desired.

The actuator 20 may optionally further comprise a self-positioning device 30 for setting or returning the output member 24, and hence the flow regulator 18, to a predetermined reference position when power is removed from the actuator device 12. For example, the reference position may be a fully closed position, or a fully open position. In some embodiments, the device 30 may comprise a mechanical energy storage device, such as a spring, that urges the output member 24 to the reference position. In other embodiments, the device 30 may comprise an electrical energy storage device, such as a battery or a super-capacitor, for providing reserve power to the actuator 20 to move automatically to the predetermined reference position.

The actuator 20 further comprises a controller 32 for driving the motor 22 to effect instructed movements of the regulator. The controller 32 also receives signals from one or more sensors 34 associated with the actuator 20, optionally associated with the motor 22. Sensing parameters at the motor 22 may be technically easier to implement. The sensors 34 may include one or more chosen from the group consisting of load sensors, force sensors, torque sensors, current sensors (I), voltage sensors (V), power sensors, speed sensors, position sensors (Pos) and temperature sensors (° T).

The sensors 34 may be physical sensors for directly sensing a parameter, and/or virtual sensors for deriving a value of a sensed parameter from other measurements. For example, a position sensor may derive a calculated position from an aggregate of position increments sensed by an increment sensor. A position of the output member 24 may also be calculated from an equivalent position of the motor rotor shaft by taking into account hysteresis or backlash in the transmission 26. For example, hysteresis may account for about 5° of position rotation. An operating range of 0-95° determined at the rotor shaft may correspond to actual movement of the output member 24 in a range of 0-90°. The initial 5° of rotor motion is lost in hysteresis. The remaining range of 5-95° determined at the rotor shaft thus corresponds to the 0-90° movement of the movable member 24.

Depending on the motor 22, and for example a vector controlled motor, it may also be possible to derive position and/or torque measurements from signals induced by spatial magnetic conductivity fluctuations in the motor 22. Such a technique is described, for example, in WO-A-99/39430.

The controller 32 may also receive signals from one or more external sensors 36. The external sensor(s) 36 may, for example, be associated with the flow regulator 18, or with a different part of the HVAC system, or with the building or other installation in which the HVAC system is implemented. The external sensor(s) 36 may, for example, sense fluid flow, fluid speed, fluid pressure in the fluid path, and/or temperature, and/or a degree of contamination or pollution of the fluid in the fluid path, and/or an actual operating position of the actuatable element 18.

The sensors 34 (and 36) may be of one or more different types including, for example, optical sensors, sonic sensors, and magnetic sensors.

The flow control device 12 is responsive to commands from a system controller 38 with which the or each control device 12 is in operative communication via a communication channel, which may be wired and/or optical and/or wireless.

Also illustrated in FIG. 1 is a remote data processing system 40, which may be in operative communication with the actuator controller 32 and/or the HVAC system controller 38, optionally via portable apparatus 42 (described later) or via one or more communication channels independent of portable apparatus 42. The communication may, for example, be via an internet address and/or internet communication protocol, or other network or direct communication. The remote data processing system 40 may be a so-called cloud system or service. The connection may be permanent or it may be occasional, for example, on-demand. The connection may be wired, and/or optical and/or wireless.

A feature of this embodiment is the ability to automatically diagnose a malfunction of the device 12, whether an actual or forthcoming malfunction of the device 12, based on the signals sensed by the sensors 34 (and optionally 36). The diagnosis may also include distinguishing whether the malfunction (actual or forthcoming) is in the actuator 20 or the flow regulator 16. This can facilitate the task of corrective action to repair or mitigate the malfunction. Depending on whether the fault is caused by the flow regulator, or by the actuator, the appropriate specialist for the respective unit can repair, replace, or perform other maintenance on the appropriate unit. Diagnosis of a forthcoming malfunction can permit timely inspection and maintenance to prevent the malfunction actually occurring.

The diagnosis may be performed by the actuator controller 32, and/or by the HVAC system controller 38 and/or by the remote processor 40.

Diagnosis is performed based on a data model 48 representing the device 12 and/or device performance. The data model 48 may best be understood by referring firstly to a performance curve (FIG. 2) representing variation of a characteristic during a cycle to open and close the flow regulator 16. The performance curve may be a load curve, such as a force curve or a torque curve. In the illustration, the performance curve is a torque curve 50, although it is to be understood that references herein to torque are to be understood as applying equally to load and/or force characteristics. Torque may be measured or calculated, or it may be assumed to be proportional to the current flowing through the motor 22. However, other performance curves (e.g. speed, voltage, power, etc) may be used additionally or alternatively, as desired. Also, although the performance curve is representative of operation in a fire damper, the same principles may be used for other types of flow regulator. FIG. 3 highlights certain characteristics derivable from the performance curve of FIG. 2. At least one, preferably some, more preferably a majority, and optionally all, of these characteristics may be useful for the data model 48.

Figure 2:
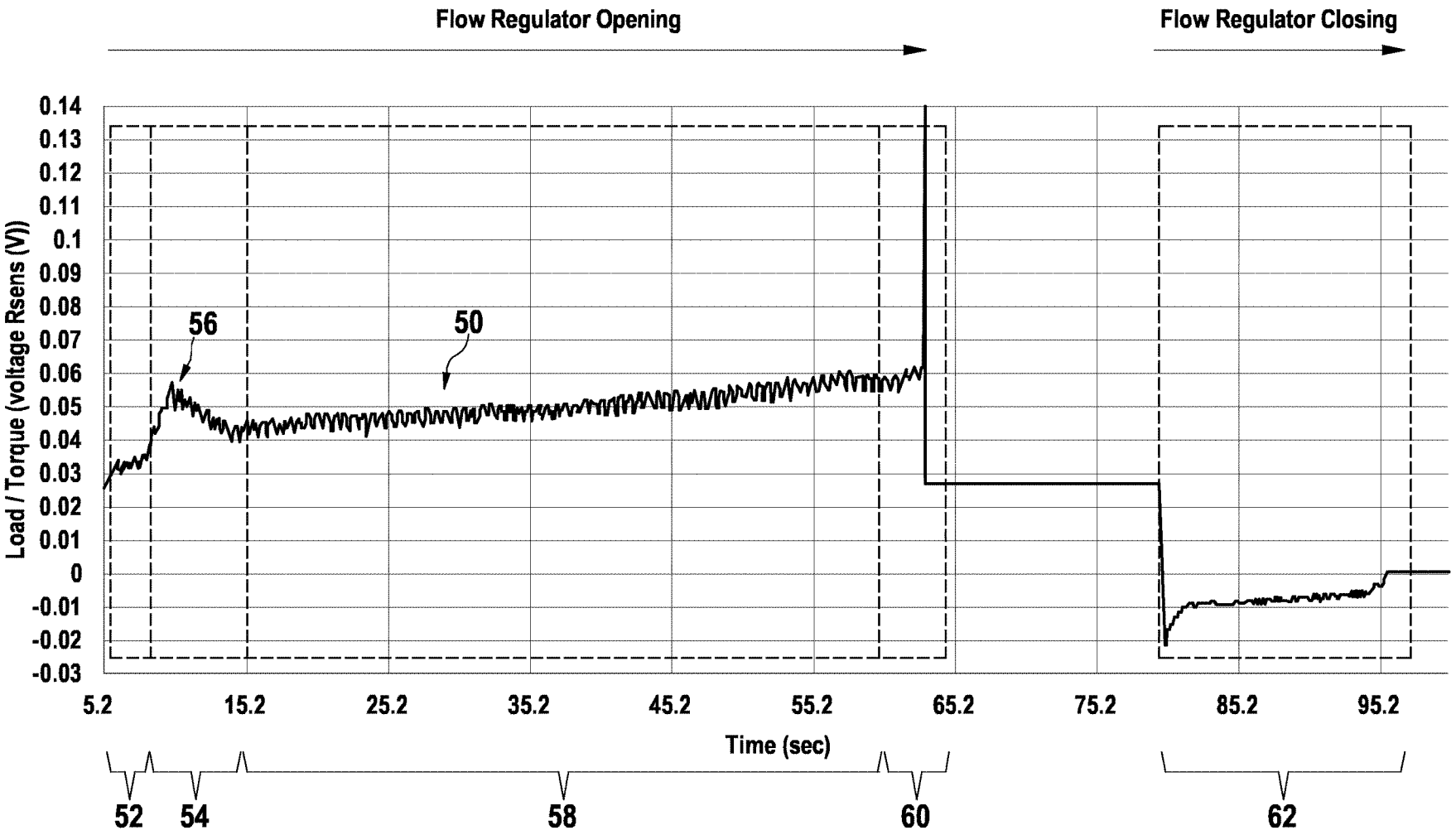
FIG. 2 is a schematic graphical representation of a torque curve for a flow control device used in FIG. 1.
Figure 3:
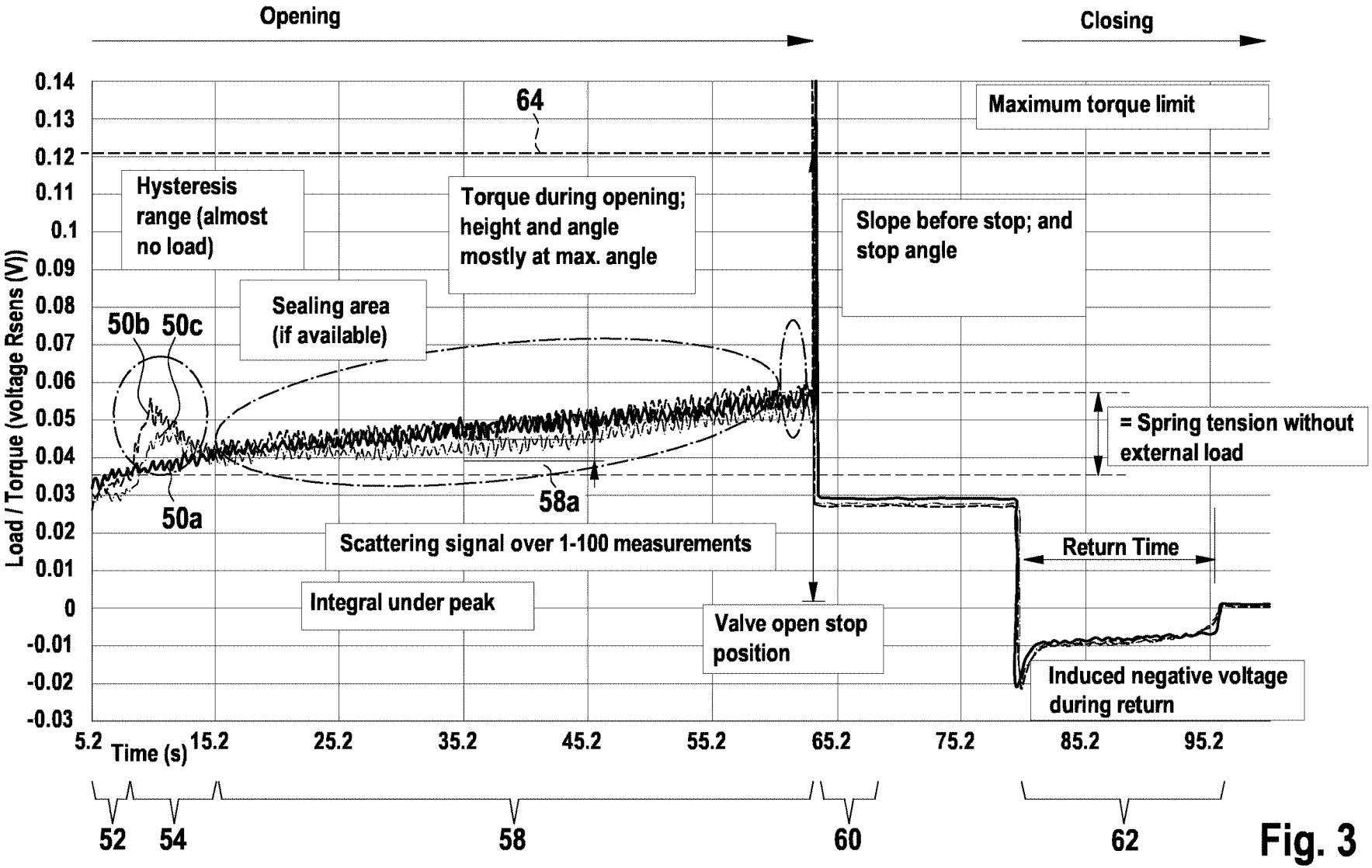
FIG. 3 is a more detailed schematic graphical representation of a torque curve similar to FIG. 2.

Referring to FIG. 2, a technique of the present disclosure is to divide the performance (e.g. torque) curve 50 into certain operating windows or zones. Each window represents a phase of operation in which associated parameters can track how the actuator 20 and the flow regulator 16 are behaving, and can reveal actual or forthcoming faults.

A first window (or "hysteresis" window) 52 is when the motor 22 starts turning, from a 0° rotational positon. Mechanical backlash or hysteresis in the transmission 26 may result in the motor rotor turning up to about 5° without significant movement of the output member 24. Referring to FIG. 3, during this window, the torque is relatively low, and may be referred to as the "minimum torque" that is generated by the motor 22 during the cycle. The torque curve is influenced primarily by the condition of the actuator 20, ie. by the motor 22 and the transmission 26. This window may be represented by one or more of: angular position information of the first window (e.g. one or more of: start position, end position, angular width); and/or torque information defining the torque during the window (e.g. max torque and/or mean torque).

Figure 4:
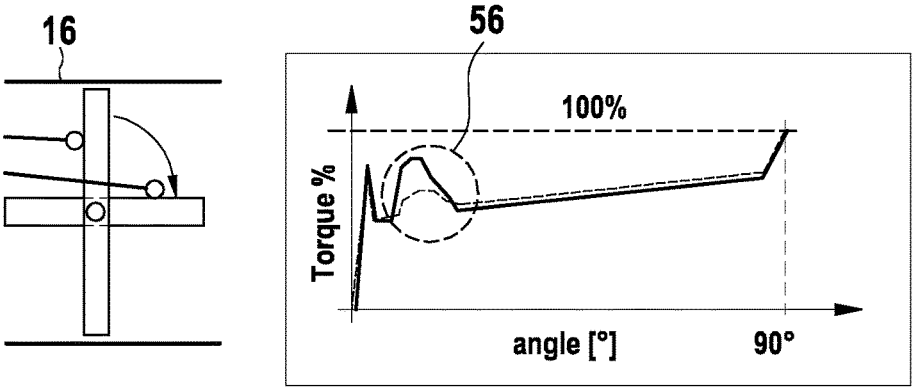
FIG. 4 is schematic illustration showing an influence of seal behaviour on a torque curve.

Referring to FIGS. 2 and 3, during a second window ("seal opening" window) 54, the output member 24 begins to move and cause the flow regulator 16 to begin to open. A seal of the flow regulator 16, creates additional friction during this opening movement, and the torque rises to a local peak 56 before dropping back down to a modest level once the seal has opened. One example of such a seal is a lip-seal that has to be forced to flip-over on itself when moving away from the closed condition, resulting in a pronounced peak 56. During this second window, the rotor may turn from about the 5° position to about the 20° positon. The local peak 56 results from the action of the seal, and provides an indication of seal condition. For example, FIG. 4 illustrates an effect of the seal weakening or failing to operate, which may reduce the height of the local peak 56, and shift the angular position of the peak 56. The second window may be represented by one or more of: angular position information of the second window (e.g. one or more of: start position, end position, angular width); and/or information about the nature of the peak (e.g. peak height, angular position of the local maximum within the second window, a mathematical integration of the peak curve, which provides an indication of the area under the peak).

Figure 5:
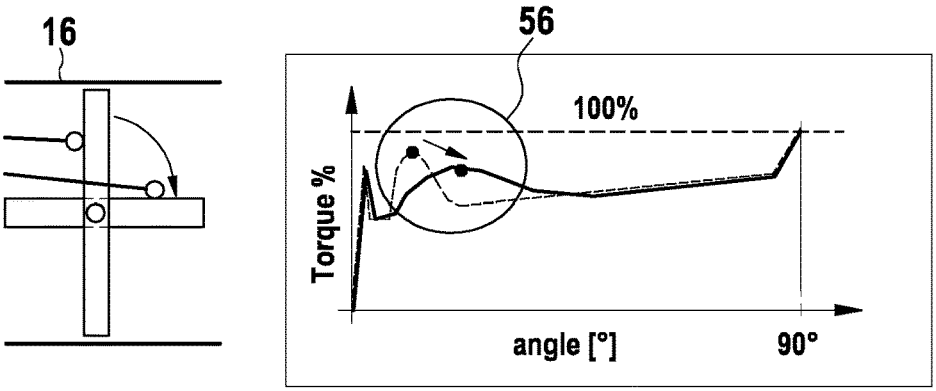
FIG. 5 is a schematic illustration showing a first example of influence of flow regulator wear on a torque curve.
Figure 6:
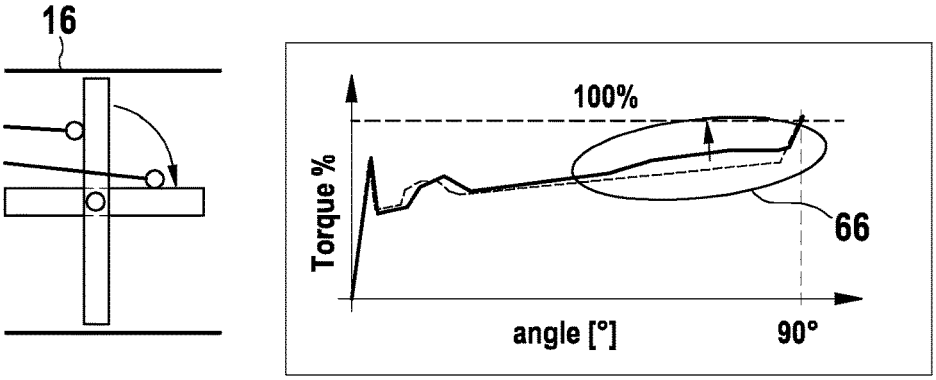
FIG. 6 is a schematic illustration showing a second example of influence of flow regulator wear on a torque curve, specifically a damper bearing becoming defective.

During a third window ("progressive" window) 58, the torque variation remains generally uniform as the motor 20 drives the flow regulator progressively towards fully open. In this example, where the actuator includes a spring ("return spring") 30 to return the flow regulator to a closed position when power is cut-off, the torque increases linearly modestly as the motor works to compress/extend the return spring 30. The motor rotor turns from about the 20° position to an about 85° position. The third window 58 corresponds to the main movement range of the actuator 20 and the flow regulator 16. The torque generally rises progressively modestly throughout the window, and any scattering of the torque (e.g. standard deviation), which may be a sign of bearing condition, is most evident in this window. The third window may be represented by one or more of: angular position information of the third window (e.g. one or more of start position, end position, angular width); and/or scattering information (e.g. standard deviation about mean); and/or curve shape information (e.g. max torque value and/or corresponding angular position). Scattering may be evaluated by sampling, for example, about 100 data points within the window, and calculating a standard deviation. The standard deviation may be a single value for the window 58 as a whole, or for a representative segment 58*a* of the window 58, or the window 58 may be sub-divided into multiple segments, and a standard deviation calculated for each segment. As can be seen in FIG. 3, the minimum torque is expected at the start of the window, and the max torque is expected at the end of the window. FIGS. 5 and 6 illustrate how a faulty flow regulator 16 may influence the torque in the second window. FIG. 5 illustrates a worn valve bearing unable to properly support the forces applied by the actuator 20. The seal peak 56 may be displaced, and the torque curve in the third window is non-linear. FIG. 6 illustrates a worn valve requiring increased torque 66 towards the end of travel in the third window, also resulting in a non-linear torque characteristic.

Referring to FIG. 3, the actual torque at the end of the third window may also be registered, whether or not this is the absolute maximum. A difference between the initial torque at the start of the first window 52, and the final torque at the end of the third window 58, is also indicative of the amount of energy stored in the return spring 30, and hence of the condition of the spring 30. This value may be referred to as a "rise feather".

Figure 7:
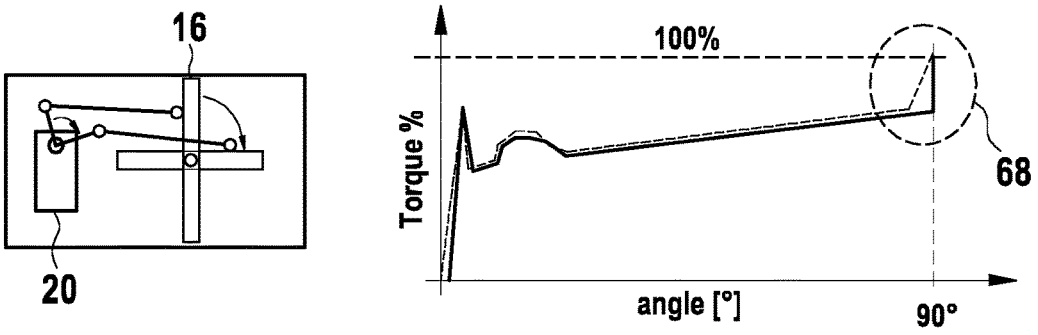
FIG. 7 is a schematic illustration showing how different behaviour when a flow regulator reaches an open position, influences a torque curve.

Thereafter, during a fourth window ("open stop" window) 60, the flow regulator 16 reaches the fully open position, and comes to a hard stop. The torque increases abruptly almost with a step change impulse characteristic as the motor 20 stalls. This phase of operation may correspond to the rotor turning from about the 85° position to about 95°. The abruptness of the stop may also indicate the condition of the flow regulator 16 and the coupling 28 to the actuator. In case of the actuator member 18 being obstructed before full opening, or in case of the coupling 28 becoming worn or weak, movement tends to slow more progressively before coming to a complete stop. For example, the coupling 28 may deform slightly under the stop load. The torque curve will then have a less abrupt slope, especially at the start of the fourth window 60, as illustrated for example in FIG. 7 at 68. The fourth window may be represented by one or more of: angular position information of the fourth window (e.g. one or more of start position, end position, angular width); and/or slope information of the torque curve (e.g. a mathematical derivative and/or differential value indicative of gradient).

The difference in angular position from the start of the first window 52 to the end of the fourth window 60, also provides a total travel indication of the actuator 20 moving from closed to open.

The total time duration from the start of the first window 52 to the end of the fourth window 60, provides additional significant information about how quickly the control device 12 operates.

The torque curve is also illustrated to include a fifth window ("return" window) 62 corresponding to the spring 30 returning the driver member 24 and the flow actuator 16 to the fully closed position when the power is cut-off from the motor 20. During the fifth window 62, the torque curve becomes negative as the spring drives movement of the motor 20, inducing a generated current and voltage in the motor. The time duration to complete the self-return provides an indication of the condition of the spring 30 and/or a degree of friction in the actuator 20 and the flow regulator 16. The voltage or current induced in the motor 20 during the return can also provide an indication of the degree of uniformity of the return speed. The fifth window may be represented by one or more of: time information representing the self-return time; voltage and/or current information representing the return path characteristics.

Figure 8:
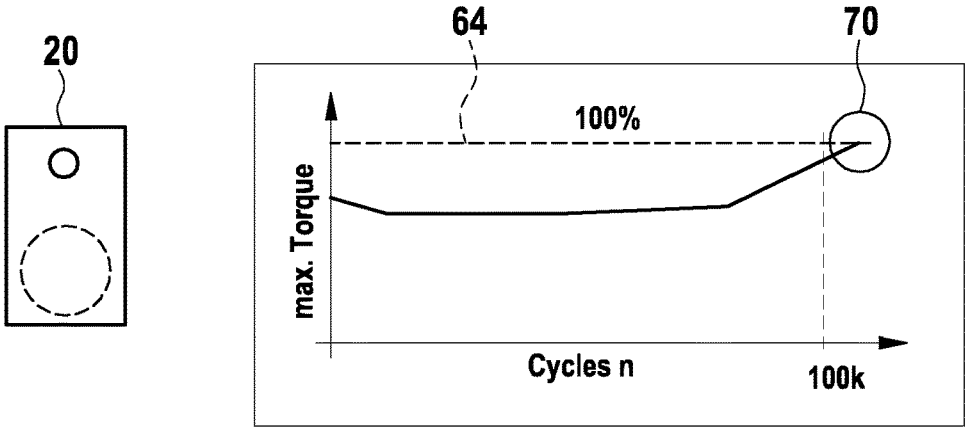
FIG. 8 is a schematic illustration showing influence of actuator wear on the torque curve.

FIG. 3 also indicates a maximum permissible torque threshold 64 set for the control device 12. The threshold 64 represents a safety limit that ought not to be exceeded in normal use of the control device 12, notwithstanding the momentary impulse upon the flow regulator 16 reaching maximum open, which triggers the controller 32 to stop the actuator 20 at that point. For example, FIG. 8 illustrates a faulty actuator 20 that, due to increased friction or bearing wear over time, requires greater torque generation to drive the flow regulator, ultimately (at 70) exceeding the maximum threshold 64 after, for example, around one hundred thousand operating cycles.

FIG. 3 also shows variation in the torque curve 50 depending on when the torque curve 50 is taken. A preferred feature of the present disclosure is that performance information is registered at different production and installation stages of the control device 12. The data model 48 may be based on, and/or comprise, performance information registered at these different stages.

For example, a first torque curve 50*a* is shown for the actuator 20 measured before it is mated with, or assembled to, the flow regulator 16. This can provide information associated with the actuator 20 per se independent of the influence of the flow regulator 16. It can be seen in FIG. 3 that the first curve 50*a* is absent the local peak 56, and information registered from the first curve 50*a* provides a view into pure actuator behaviour even outside the hysteresis window 52.

A second torque curve 50*b* is shown for the actuator after manufacture and assembly with the flow regulator 16. It can be seen in FIG. 3 that the second curve 50*b* includes a relatively pronounced local peak 56, in contrast to the first curve 50*a*. Information registered from the second curve 50*b* provides a view into the performance of the actuator 20 and flow regulator 16 together, when new.

Figure 9:
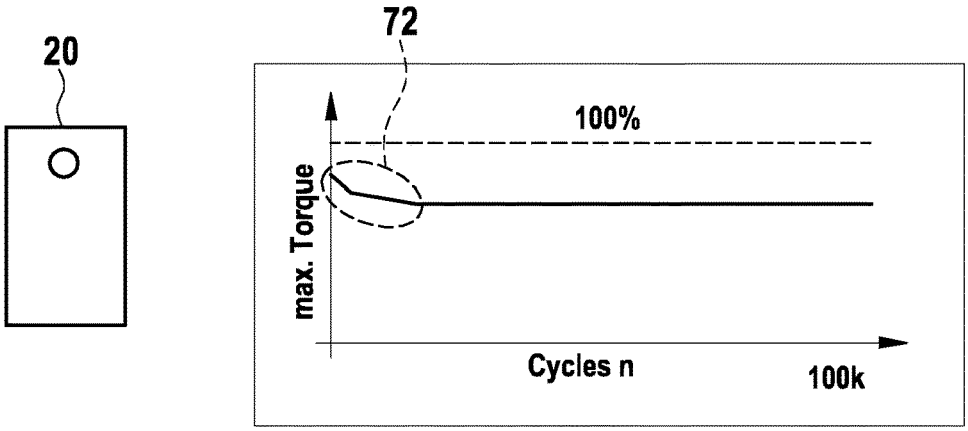
FIG. 9 is a schematic illustration showing influence of running-in of an actuator on a torque curve.

A third torque curve 50*c* is shown for the device 12 after it is installed in an HVAC system, and after a certain number of operating cycles to allow the parts to run-in. It can be seen in FIG. 3 that this third curve 50*c* is generally lower than the second curve 50*b* when new. Running-in of the parts reduces friction in the actuator 20 and flow regulator 16. Also lubrication grease within the transmission 30 may be relatively viscous or gummy when new. Running-in reduces the viscosity of the grease, also contributing to reduced friction. FIG. 9 also illustrates at 72 the reduction in torque with increasing operating cycle count, as the actuator 20 runs-in.

Figure 10:
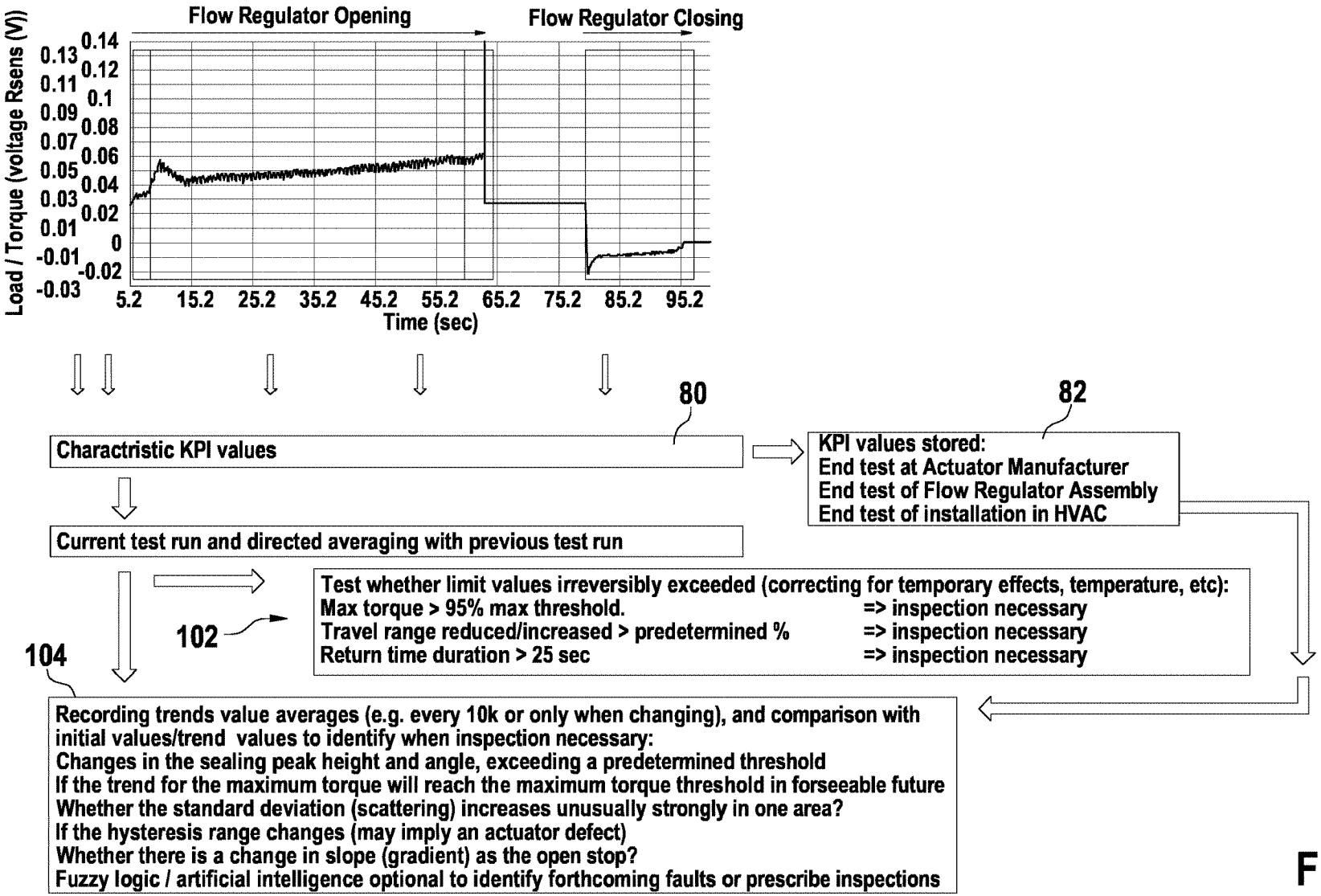
FIG. 10 is a schematic flow diagram showing information processing steps and modules for detecting malfunctions based on a data model and inputs received from sensors.

Referring to FIGS. 10 and 11, the information discussed above derived from the performance curve(s) is/are referred to as KPI (key performance indicator) 80. FIG. 10 is a schematic map showing processing steps or modules for processing KPI for analysis. FIG. 11 is a table indicating how different KPI parameters can be interpreted to distinguish between malfunctions of the actuator 20 (left column) and flow regulator 16 (right column).

Referring to FIG. 10, the KPI 80 is obtained at three different stages 82 of manufacture and installation discussed above, namely (i) for the actuator 20 alone prior to assembly to the flow regulator 16; (ii) for the actuator 20 and flow regulator 16 together after assembly; and (iii) for the control device 12 once installed in an HVAC system, and optionally after a period of running-in. Additionally or alternatively, KPI may be obtained for the control device during, or immediately after, or shortly after installation in an HVAC system, so that any changes or effects of the installation on the control device 12 may be taken into account (e.g. even before running in) compared to the control device 12 as new. Optionally, characteristics may be measured for the control device 12 immediately before installation. This can enable effects such as distortion of the fluid flow path by the duct to be accounted for.

The KPI 80 forms at least part of the data model 48. In order to diagnose current performance, either during a dedicated test run or during normal operation of the HVAC system, current values of KPI parameters are calculated from the signals supplied by the sensors 34 (and optionally 36) during a partial or complete open-close cycle commanded by the controller 32. Also, KPI from one or more previous runs are used in the form of historical data, optionally a weighted average, to enable tracking of changes and/or trends in the KPI. The previous KPI and/or weighted average may be stored as part of an evolving data model, or as separate information.

Referring to FIG. 11, the KPI 80 in the data model may comprise one or more (optionally at least some and/or at least a majority, and/or all) of:

84: first torque information (e.g. max torque) associated with the first window 52 (e.g. associated with actuator hysteresis).

86: second torque information (e.g. peak torque 56) associated with the second window 54 (e.g. associated with the seal).

88: third torque information (e.g. max torque) associated with the third window 58 (e.g. associated with the progressive opening of the flow regulator).

90: fourth torque information associated with a difference between the torques at the start of the first window and at the end of the third window (e.g. associated with the energy stored in the spring 30).

92: fifth torque information associated with scattering of the torque during the third window (e.g. a calculated standard deviation).

94: sixth torque information associated with a calculated integral of the peak 56 in the second window.

96: full-travel range information associated with the operational range of movement of the control device 12, for example, based on the angular range or difference between the start of the first window 52, and the end of the fourth window 60.

98: time formation associated with the time duration for the fifth window 62 (e.g. the return time to return from open to closed under the force of the spring 30).

Optionally, the KPI may further include seventh torque information (not shown) associated with a calculated gradient of the slope at the start of the fourth window 62 (e.g. associated with indications of how the flow regulator 16 stops at its open position).

Referring to FIG. 10, at 102, the current KPI is compared with certain thresholds in the data model to see whether certain safety limits are being exceeded, namely:

(i) whether the torque (or a maximum value of the torque) during one of the windows exceeds or approaches the maximum permissible torque threshold 64. In the current example, it is determined whether the torque exceeds a certain fraction, e.g. 95%, of the permissible threshold 64 for the purposes of generating a warning. Such high torque values indicate increased friction or other resistance to movement that should be checked by inspection. A warning of excessive torque, without other indicators, may be associated with a malfunction of the actuator 20.

(ii) Whether the total travel distance or angle (e.g. from closed to open) has changed significantly compared to the historical total travel. For example, it may be determined whether the total travel has increased or decreased by more than a certain proportion compared to the historical total travel information and/or compared with similar travel information from other flow control units 12 (which may be included in the data model and/or supplied as external information). Any change to the total travel, beyond modest changes, may indicate a malfunction. Reduced travel may indicate that the flow regulator 16 is failing to open or close completely. Increased travel may mean that the flow regulator 16, its seal, the coupling 28, or the actuator 20 is failing.

(iii) Whether the return time duration (e.g. time information 98) exceeds a certain limit threshold, for example, about 25 seconds. A longer return time may indicate increased friction, or that the return spring 30 of the actuator 20 is failing. It may also be relevant to safety criteria for the flow control device 12 in the event of a fire emergency, namely that the flow regulator 16 should always move to the closed position within a certain permitted time limit.

At 104 (FIG. 10), the current KPI are further analysed to determine trends in the KPI compared to historical KPI, and optionally compared to predicted KPI (discussed later). For example, the analysis may concern one or more or all of:

(i) Whether the first "hysteresis" window 52 is changing in size, for example, whether the angular width increases. Changes to the first hysteresis window 52 may indicate that the actuator 20 is currently or becoming defective. Optionally it may be determined whether an increase in angular width of the first window is accompanied by similar increases in width of other windows.

(ii) Changes for the local peak 56 relating to the seal, for example, changes in the height and/or angular position and/or calculated integral of the peak 56.

(iii) Whether a trend (88, FIG. 11) for the maximum torque is increasing abnormally. It may also be determined whether the torque is predicted to exceed the maximum permissible torque 64 within a certain timeframe or usage period, which may also be an issue with the actuator 20.

(iv) Whether the standard deviation (92 in FIG. 11) increases unusually in one or more areas, for example, in the third window 58. An increase in standard deviation may indicate wear, for example, in the actuator 20.

(v) Whether the gradient calculated for the fourth window 60 is changing.

(vi) Whether the spring return value (90 in FIG. 11) calculated from the difference between torque values is changing.

(vii) Whether the angular range of travel (96 in FIG. 11) is changing.

(viii) Whether the return time (98 in FIG. 11) of the fifth window 62 is changing, especially increasing significantly.

The above analysis and diagnosis may be implemented by suitable automated techniques, for example, by one or more of machine learning, a neural network, a fuzzy logic network, an artificial intelligence system. Parameters may be evaluated in combination to refine a distinction between whether a malfunction (actual or forthcoming) is present in the actuator 20 or in the flow regulator 16.

FIG. 11 illustrates values and trends of the KPI parameters 80 that, in isolation and/or in combination, characterise performance of the flow control device 12, and that can reveal or diagnose actual and forthcoming malfunctions. In FIG. 11, the left column identifies values/trends associated with malfunction of the actuator 20, and the right column identifies values/trends associated with malfunction of the flow regulator 16. Upward arrows indicate values increasing. Horizontal arrows indicate that changes in value are not expected and/or are not relevant. Multi-direction arrows indicate that any change in value may be relevant. Although a single set of trend values is illustrated, multiple trends associated with a variety of malfunctions in the actuator and/or the flow regulator may optionally be provided or learned by machine learning. Different trends may optionally refer to differing sets or sub-sets of the KPI parameters 80.

FIGS. 12-17 illustrate how KPI parameters 80 may be interpreted in actual testing to diagnose malfunctions.

Figure 13:
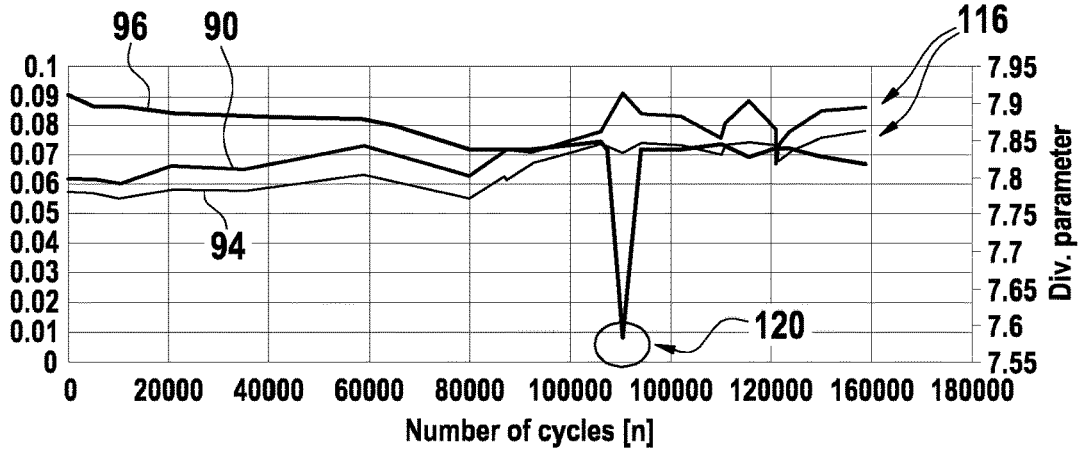
FIG. 13 is a schematic graphical illustration showing a second group of parameters for the first example in FIG. 12.

In a first example, the manner in which parameter values vary with usage (represented by cycle count) is depicted in FIGS. 12 and 13. The cycle count is indicated on the abscissa. Each parameter line is denoted by the same reference numeral used in FIG. 11. In particular, FIG. 12 shows the variation in the maximum torque information 88 from the third window 58; variation in standard deviation 92 represented by broken lines neighbouring line 88; variation in return time 98 from the fifth window 62; and variation in the hysteresis torque 84 from the first window 52. FIG. 13 shows the variation in the range information 96; variation in the spring torque (rise feather) 90; and variation in the integral 94 of the seal peak 56.

Figure 14:
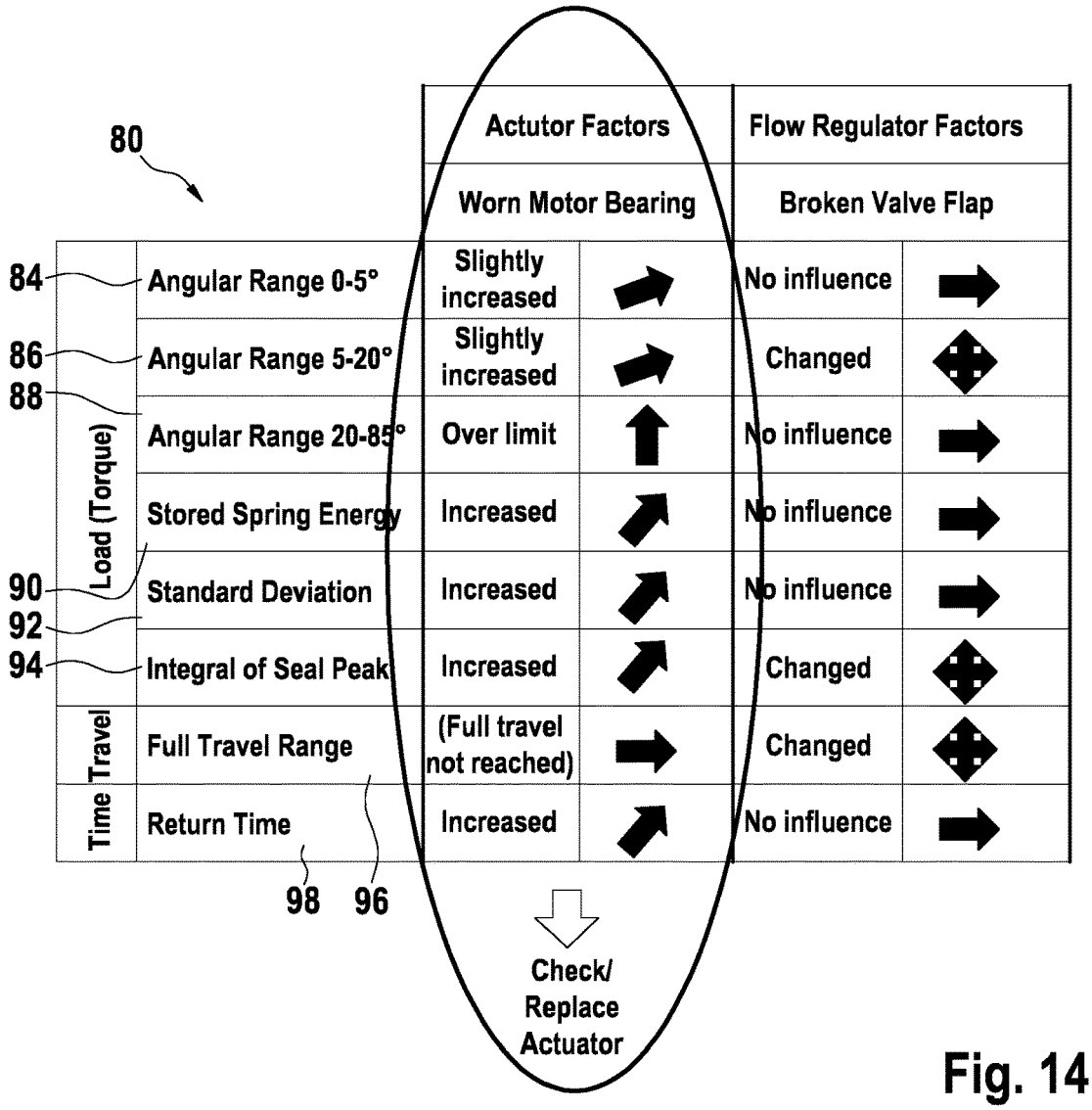
FIG. 14 is a schematic illustration showing diagnosis based on the parameters of FIGS. 12 and 13, using the diagram of FIG. 11.

Referring to FIG. 12, a first indication of a fault is apparent from the abnormal excursion 110 of the return time 98 at a cycle count of about 80K. Additional excursions of the return time 98 and of the maximum torque 88 are also detectable at three occurrences 112. In general, the maximum torque 88, the return time 98, the hysteresis torque 84 (indicated by arrow 114), the spring torque 90 and the integral of the seal peak 94 (both indicated by arrows 116) all show a trend of increasing. Referring to FIG. 14, these increases correspond generally to the trends indicated in the left column of the parameter table, indicative of a malfunction of the actuator 20. The forthcoming malfunction is apparent from the first indication at about 80K cycles, although the actuator 20 may actually manifest malfunctions after about 110K cycles.

In fact the parameters represented in FIGS. 12 and 13 represent actual test values from a flow control device 12 with a faulty actuator having a worn bearing. Also notable in FIG. 12 is that the standard deviation 92 was generally stable (indicated by arrow 118), but this does not compromise the other trends. Also notable in FIG. 13 is an abnormal excursion (120) of the travel range 96 occurring at about 110K cycles, which also would be an anomaly for triggering a warning.

Figure 15:
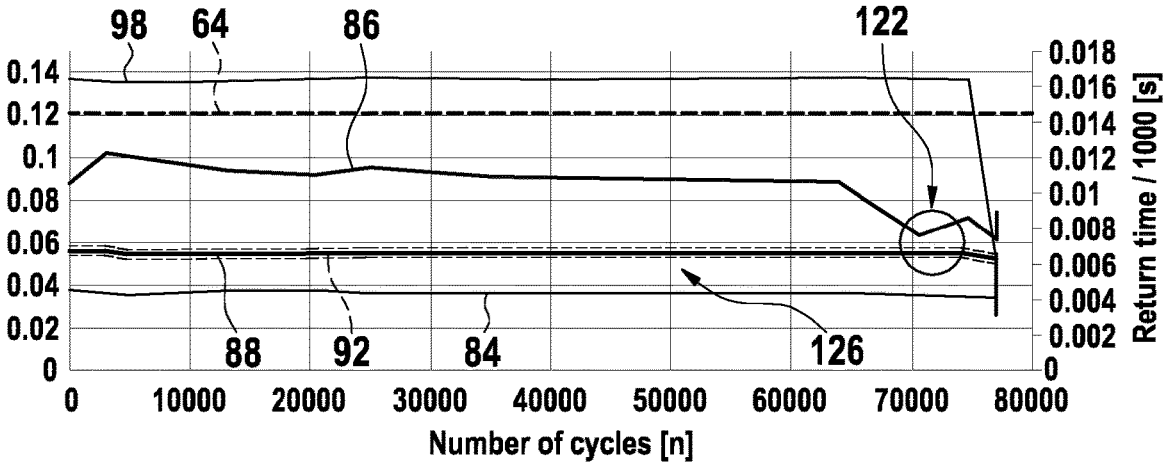
FIG. 15 is a schematic graphical illustration showing a first group of parameters in a second example of flow control device testing.
Figure 16:
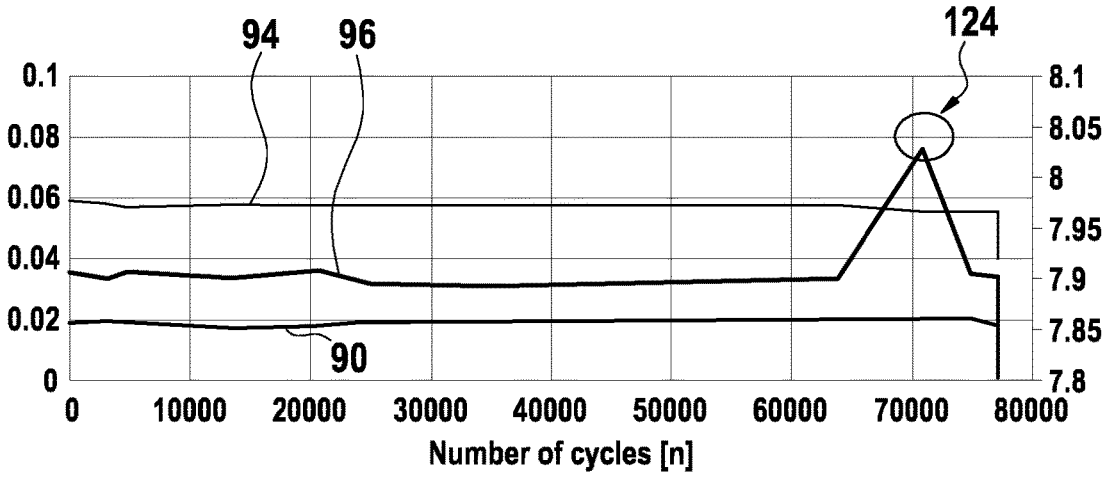
FIG. 16 is a schematic graphical illustration showing a second group of parameters for the second example in FIG. 15.

In a second example, the manner in which parameter values vary with usage (represented by cycle count) is depicted in FIGS. 15 and 16. The cycle count is indicated on the abscissa. Each parameter line is denoted by the same reference numeral used in FIG. 11. In particular, FIG. 15 shows the variation in return time 98 from the fifth window 62; variation in the magnitude 86 of the seal peak 56 from the second window 54; variation in the maximum torque information 88 from the third window 58; variation in standard deviation 92 represented by broken lines neighbouring line 88; and variation in the hysteresis torque 84 from the first window 52. FIG. 16 shows the variation in the integral 94 of the seal peak 56; variation in the range information 96; and variation in the spring torque (rise feather) 90.

Figure 17:
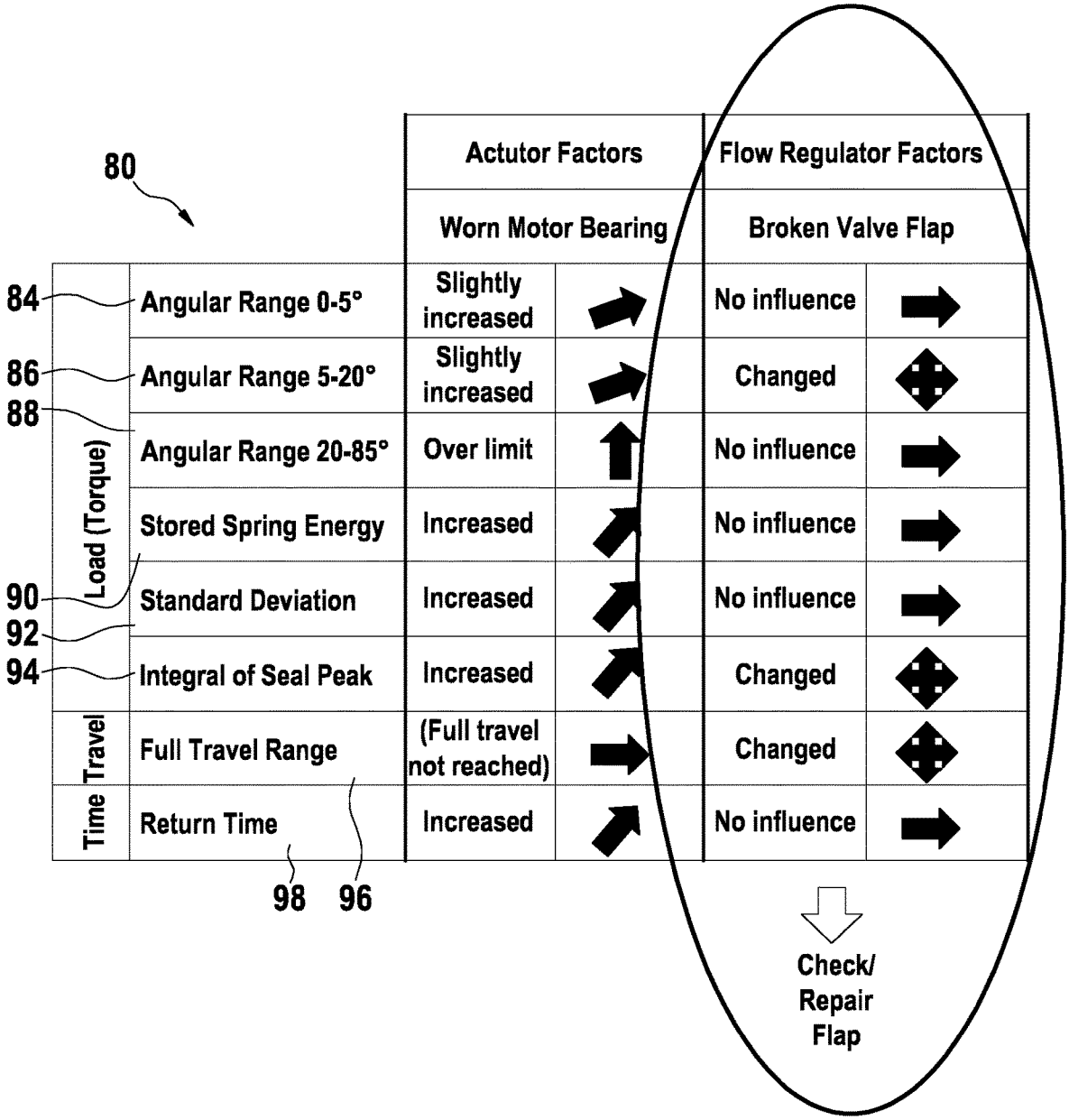
FIG. 17 is a schematic illustration showing diagnosis based on the parameters of FIGS. 15 and 16, using the diagram of FIG. 11.

Referring to FIGS. 15 and 16, an indication of a fault is apparent from the abnormal excursion 122 of the seal torque 86 and the abnormal excursion 124 of the position range 96 at a cycle count of about 70K. The calculated integral 94 also shows a decrease from about 70K cycles. Other parameters (e.g. max torque 88, standard deviation 92, and spring torque 90) generally remain flat. Referring to FIG. 17, such a combination corresponds generally to the trends indicated in the right column of the parameter table, indicative of a malfunction of the flow regulator 16. The forthcoming malfunction is apparent even earlier, from about 65K cycles, is very apparent at 70K cycles, and continues until the flow regulator stops working at about 75K cycles.

In fact, the parameters represented in FIGS. 15 and 16 represent actual test values from a flow control device 12 with a faulty flow regulator 16 that was tested until breakage. Notable in FIG. 15 (as indicated by arrow 126) is that the maximum torque and the standard deviation 92 were generally stable. Also notable in FIG. 15 is that the return time 98 also remained generally stable until the flow actuator broke and could not travel the full return distance.

Figure 18:
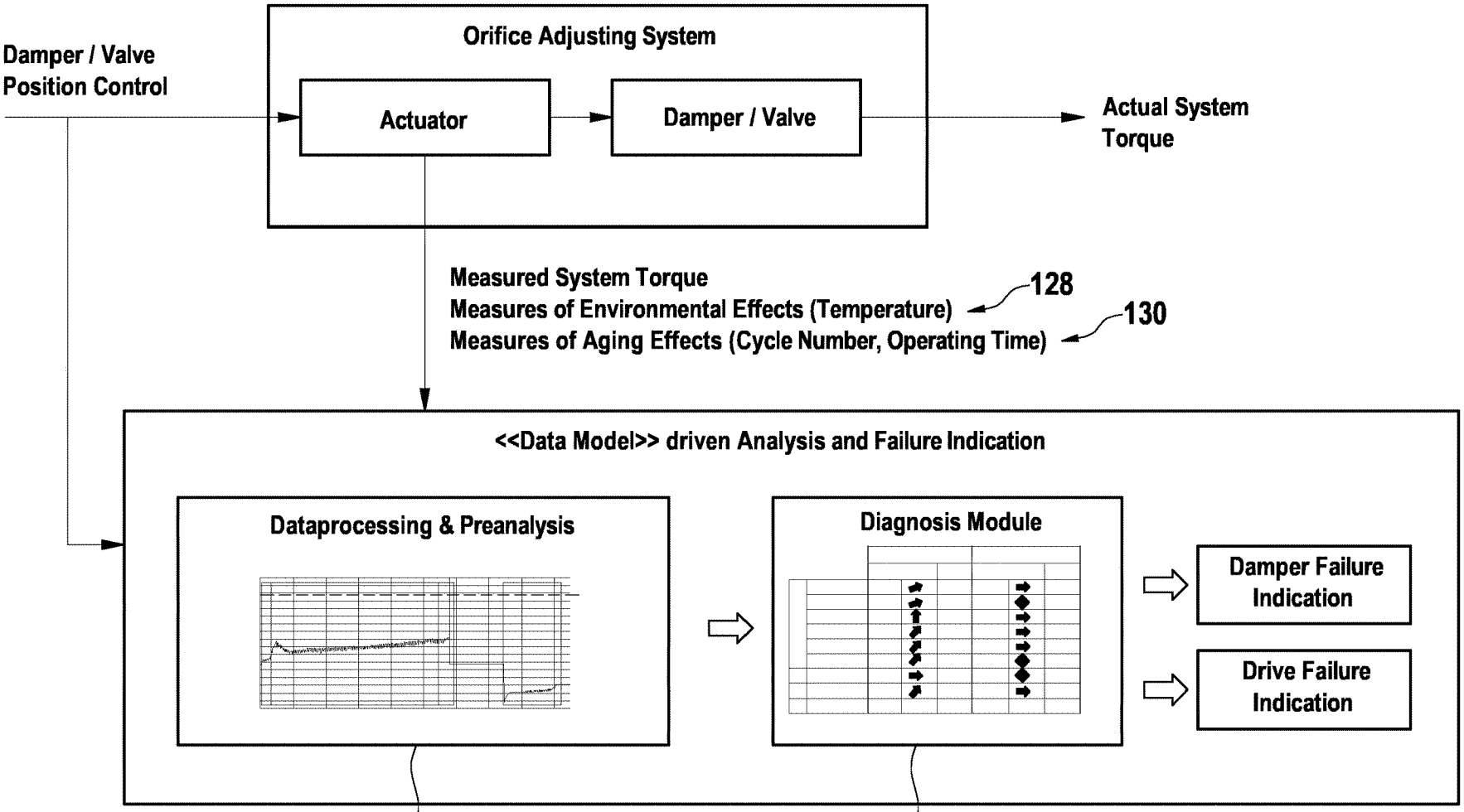
FIG. 18 is a schematic flow diagram similar to FIG. 10 with an enhancement to accommodate information relation to temporal changes.
Figure 19:
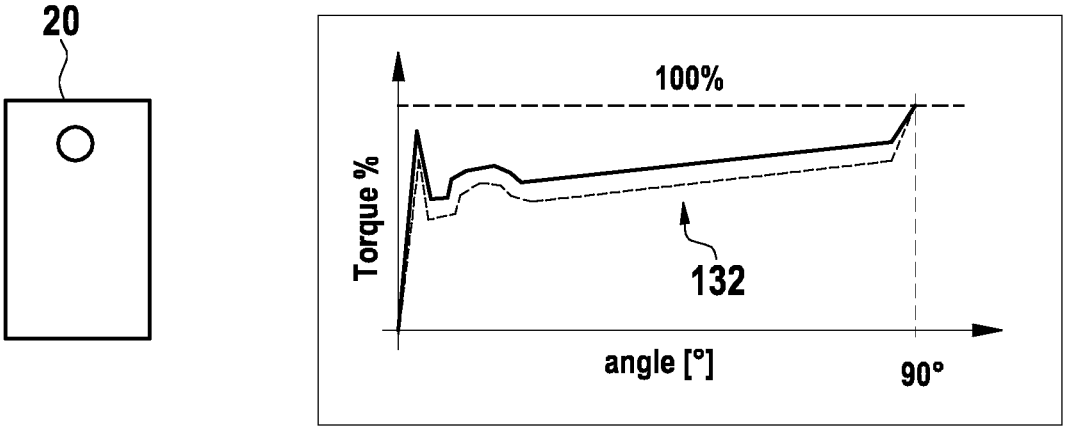
FIG. 19 is a schematic illustration showing influence of temperature on a torque curve.
Figure 20:
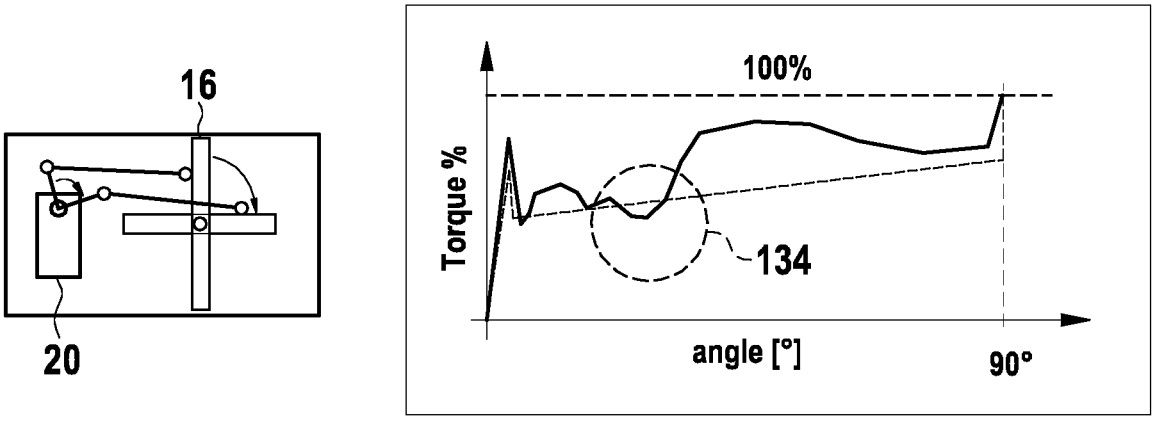
FIG. 20 is a schematic illustration showing influence of fluid pressure on a torque curve.

Referring to FIG. 18, an enhancement of the above techniques may take into account temporal influences on the KPI parameters 80. For example, temporal influences may include one or more of:

(i) Environmental effects 128, such as:

a. Temperature. As temperature increases, the coefficient of resistance of electrical coils in the motor 22 also increase, making the motor less efficient. The viscosity of lubrication grease in the transmission 26 may reduce. The influence of temperature may be generally to shift or offset the performance curve with respect to the ordinate axis. However, taking temperature into account, and compensating for corresponding higher values of the performance curve, can avoid the high values from being judged to falsely exceed thresholds. For example, FIG. 19 illustrates at arrow 132 the performance curve shifting upwardly with increasing temperature.

b. Fluid pressure. The amount of force required for the actuator 20 to move the flow regulator 16 may depend on the pressure of fluid acting on the flow regulator 16. Taking fluid pressure into account, and compensating for corresponding higher values of the performance curve, can avoid the high values from being judged to falsely exceed thresholds. For example, FIG. 20 illustrates an effect of air current, or wind, acting on the flow regulator 16. The varying forces on the regulator 16 can influence the torque curve significantly, potentially adding to the torque in some regions, and reducing the torque below the expected curve in other regions (see 134).

c. Pollution/contamination. In a similar manner to temperature and pressure, the degree of impurities in the fluid may also influence behaviour of the flow regulator 16, and the amount of force required for the actuator 20 to move the flow regulator 16. Taking pollution or contamination into account, can avoid high torque curve values from being judged to falsely exceed thresholds.

(ii) Aging effects 130: The operating age of the control device 12 may be recorded by, for example, maintaining a count of the number of times the actuator 20 has been operated, and/or the total operating time duration of the motor 20, or another parameter that aggregates usage. As discussed above in relation to FIG. 9, torque may reduce from an initially-high valve, as the actuator 20 is run-in.

Figure 21:
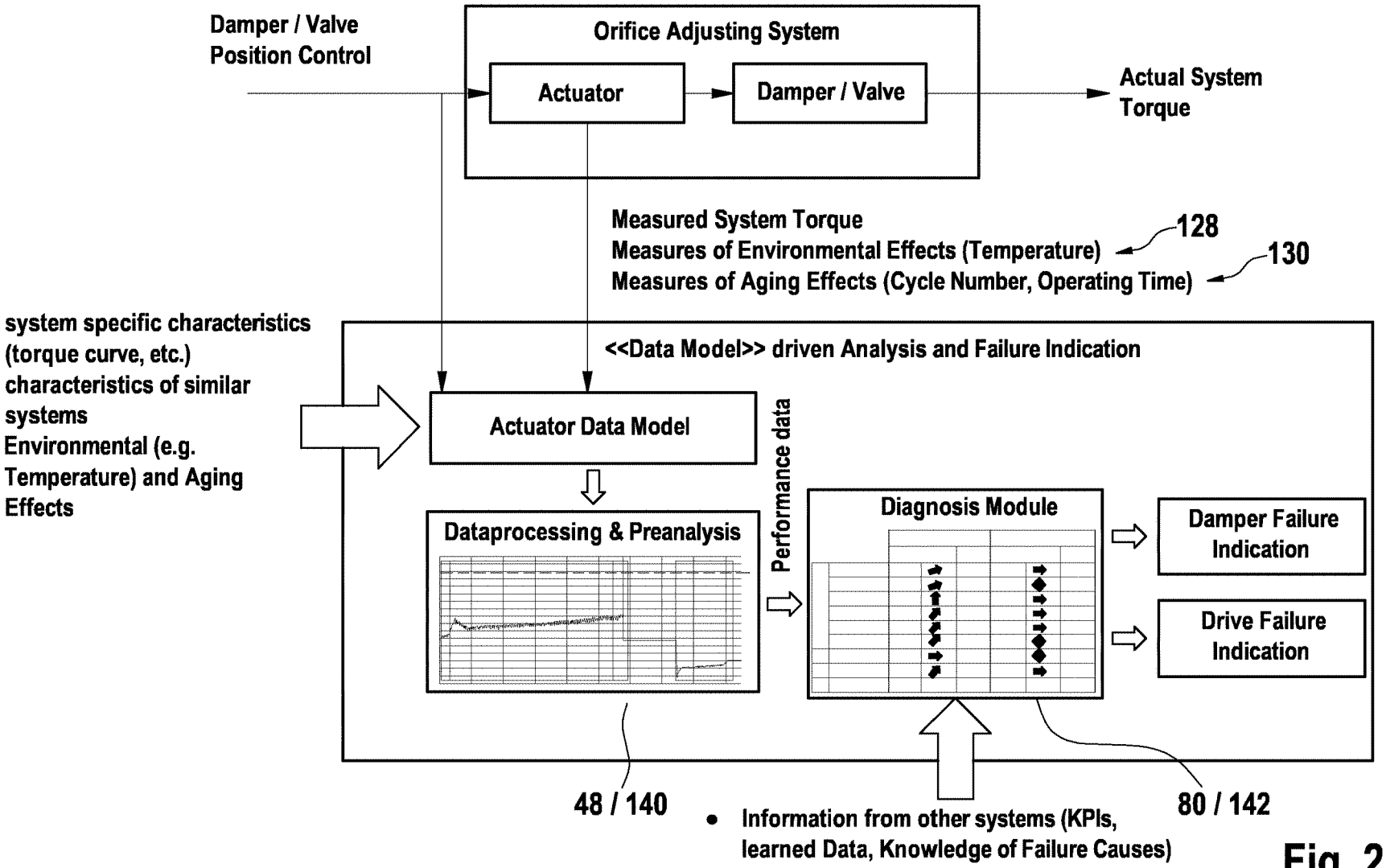
FIG. 21 is schematic flow diagram similar to FIG. 18 showing a further enhancement with adaptive analysis.
Figure 22:
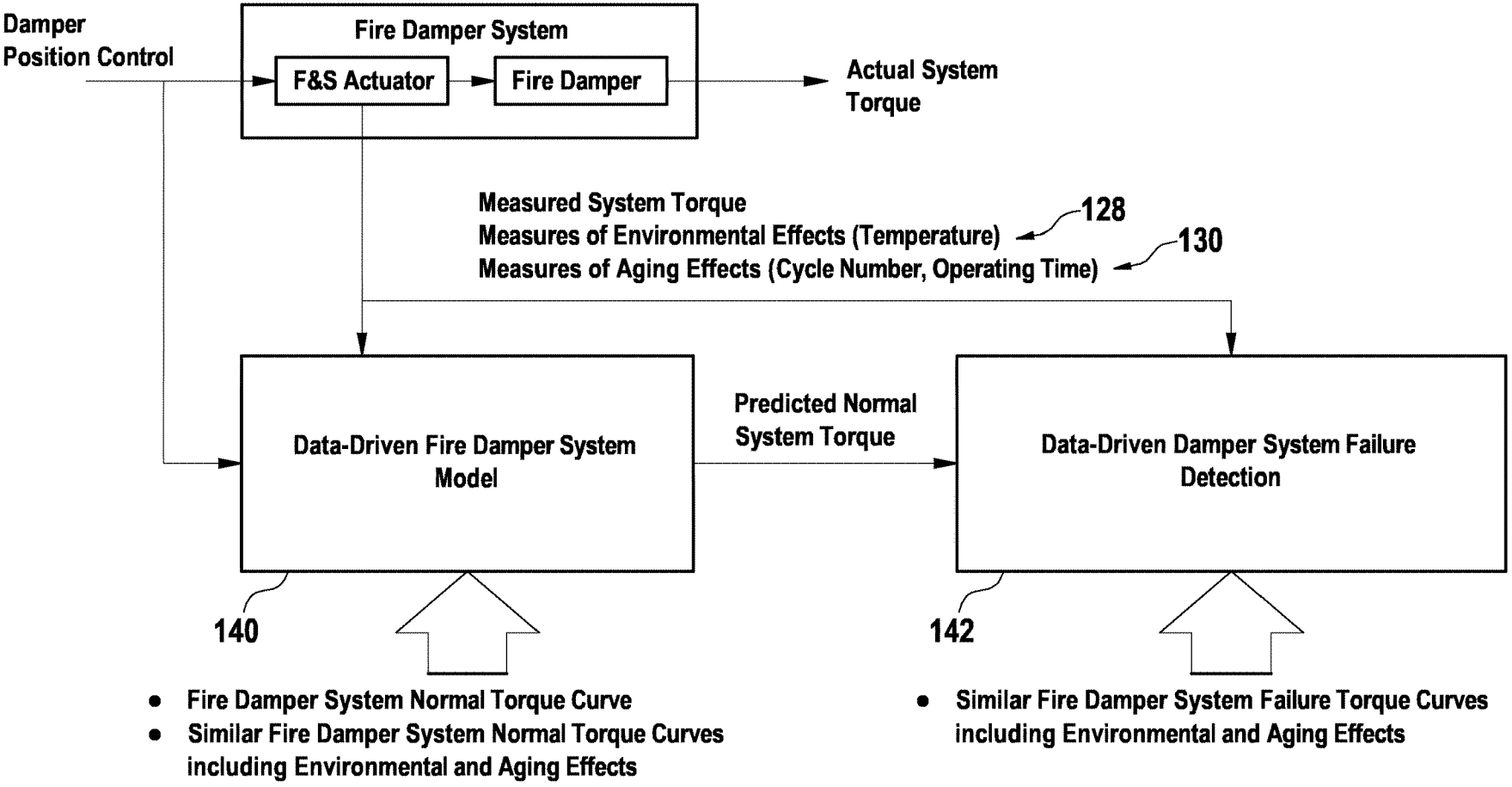
FIG. 22 is a schematic block diagram illustrating processing modules for use in the flow diagram of FIG. 21.

Referring to FIGS. 21 and 22, a further enhancement of the analysis techniques may to employ an adaptive technique. The adaptive technique may comprise one or both of:

(i) A predictive data model module 140 based on one or more of:

a. Parameters derived from the current control device 12 (e.g. measured from the actuator 20 at manufacture, and/or the actuator 20 when assembled to the flow regulator 16, and/or the control device 12 once installed into the HVAC system);

b. Parameters derived from other control devices similar to the current control device 12. For example, these other control devices may be other devices in the same HVAC system, and/or control devices 12 in other HVAC systems);

c. Environmental effects, for example, temperature and or pressure;

d. Effects of ageing (ii) An adaptive diagnosis module 142, adaptive in response to fault information derived from other flow control devices 12, optionally including environmental and ageing effects.

Such an enhanced analysis technique can be responsive to, or driven by, data from other flow control modules 12. The predictive data model module 140 enables a data module to be generated representing how the flow controller 12 is expected to perform, based on information from outside the flow controller 12 itself. Similarly, the diagnosis module 142 enables fault diagnosis based on fault information derived from other flow control devices 12.

Referring to FIG. 1, the predictive analysis may be performed in the processing system 40 that is able to receive signals from multiple flow control devices 12, optionally in the same HVAC system 10, and/or optionally in plural different HVAC systems. The controller 32 may be operable to perform a more simple analysis on-board the flow control device 12. The characteristics for the on-board analysis may be updated and/or adapted according to information available to the processing system 40, for example, using one of the communication channels or the portable apparatus 42.

Also, FIG. 1 shows the actuator 12 comprising an interface module 144 communicating with or forming part of the controller 32. The interface module 144 comprises a control interface 146 for interfacing with the HVAC system controller 38, and/or a data model interface 148 for receiving the data model information 48 and storing the data model in the flow control device 12, and/or a diagnostic interface 150 for receiving and sending diagnostic information. The diagnostic information my include the calculated KPI parameters 80, and/or signals from the sensors 34 and 36 for remote processing, and/or the results of diagnostic tests for identifying actual malfunctions and/or forthcoming malfunctions, and optionally for discriminating between malfunctions (actual or forthcoming) in the actuator 20 or the flow regulator 16.

Figure 23A:
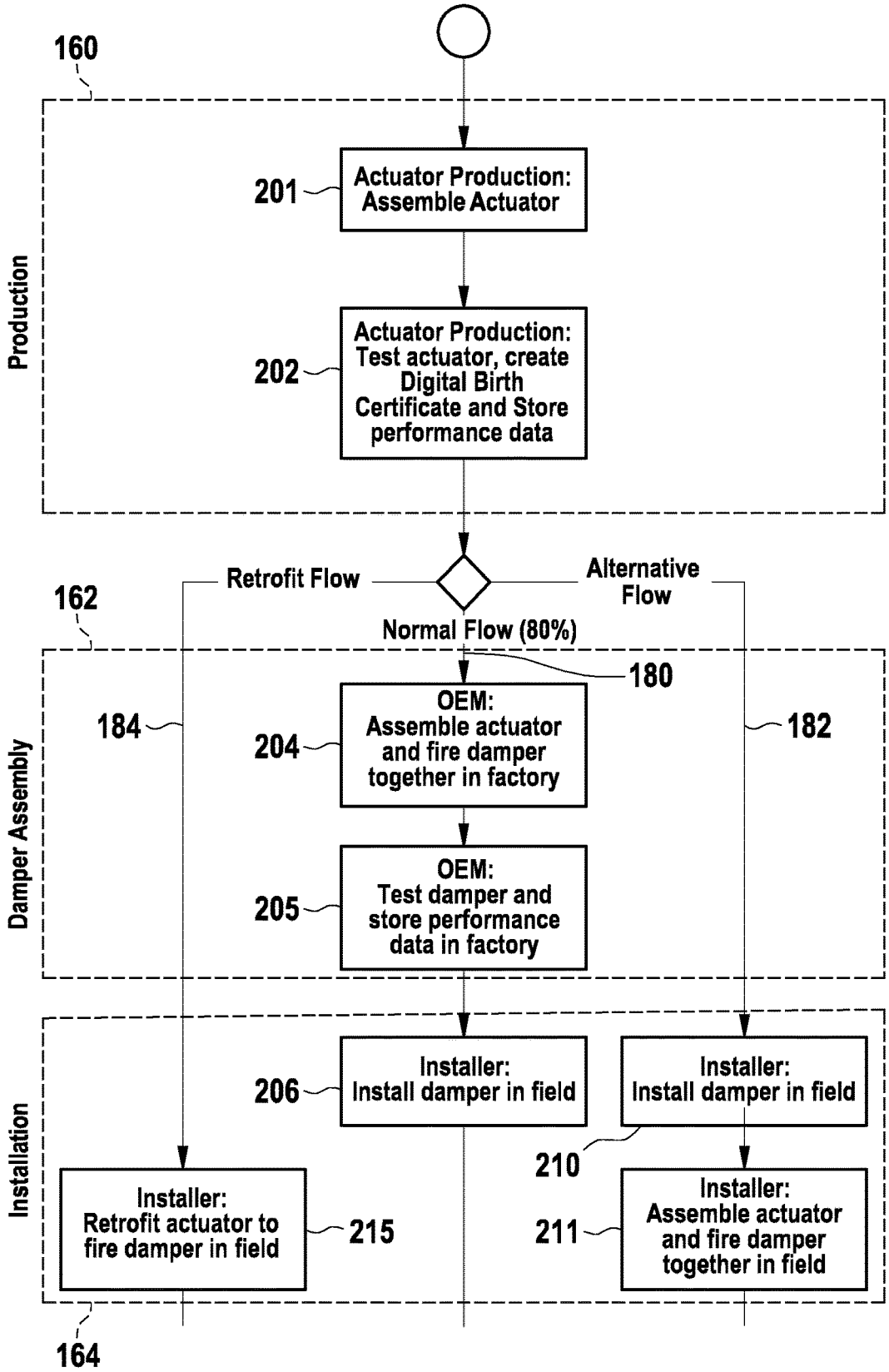
FIGS. 23*a* and 23*b* are respective upper and lower halves of a schematic flow diagram illustrating steps of manufacture through to commissioning and testing flow control devices.
Figure 23B:
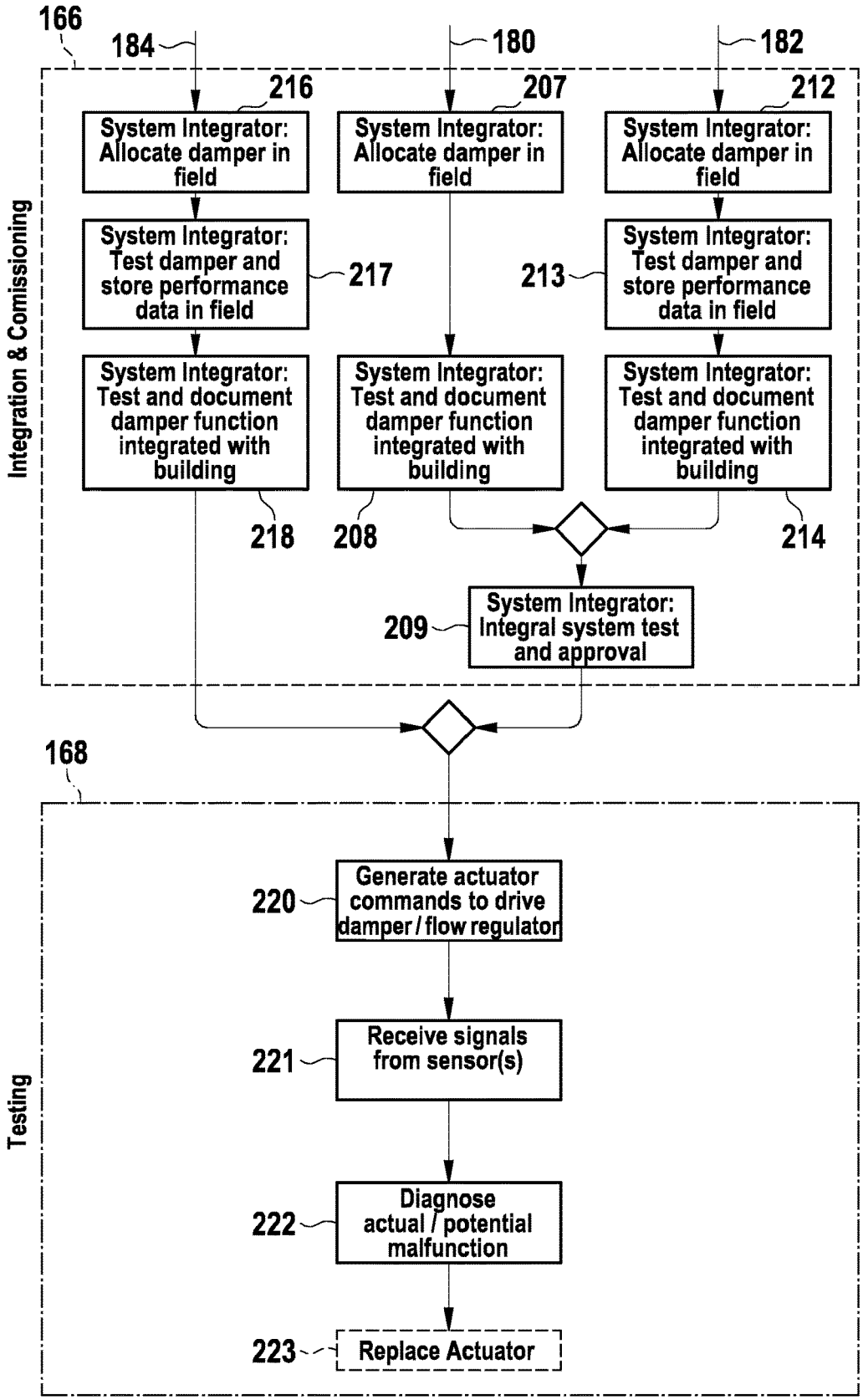

FIGS. 23*a* and 23*b* illustrate how the parameters of the flow control unit 12 are set-up and used depending on the manner of production and installation of the control unit 12. The process is divided into sections, namely: a first ("production") stage 160 representing production of a new actuator 20; an optional second ("damper assembly") stage 162 at which the new actuator 20 is assembled to a new flow regulator 16, to complete manufacture of a new flow control device 12; a third ("installation") stage 164 at which the components are physically installed into an HVAC system; a fourth ("integration and commissioning") stage 166 at which the components are made operational within the HVAC system; a fifth ("testing") stage 168 at which the function of the flow control device 12 is tested and actual or forthcoming malfunctions are diagnosed. The process is described for a flow regulator 16 in the form of a fire damper, as an example of a flow control unit 12 required to meet high safety standards. However, the same process may be applied for other types of flow regulator 16. The terms "flow regulator" and "damper" are substitutable one for the other, and are referred to interchangeably.

During the first production stage 160, step 201 represents manufacture of the new actuator 20, followed by testing of the actuator 20 at step 202. During step 202, characteristic parameters of the actuator 20 per se may be recorded for the data model, providing a view on operation of the actuator 20 alone, even outside the hysteresis window. The information may be recorded by establishing a birth-certificate and/or other unique identifier for the particular actuator 20. The information may be stored as part of the birth certificate, and/or in a separate database accessible by means of the birth certificate. For example, the information may be stored in the remote processing system 40. Additionally or alternatively, information may be inputted via the model interface 148 and stored within the actuator controller 32.

Following production of the actuator 20, the process may take one of three possible paths 180, 182 or 184, depending on how the actuator 20 is to be used.

A first path 180 represents the production of a new flow control unit 12 using the actuator 20 at the second assembly stage 162. The second assembly stage 162 may be carried out by the same manufacturer as the first stage 160, or by a different manufacturer (for example, in an OEM production process). Step 204 represents the actuator 20 being assembled to the new flow regulator 16 in the form of a fire damper, to form the new unit 12. At step 205, the assembled actuator 20 and damper (flow regulator 16) are tested together. During step 205, characteristic parameters of the actuator 20 and damper together may be recorded for the data model, providing a view on operation of the device 12 as new. The information may be recorded with and/or associated with the birth-certificate. The information may optionally be stored in the remote data processing system 40 and/or in the actuator controller 32, in a similar manner to that described above.

Still referring to the first path 180, the flow control device 12 is physically installed in an HVAC system 10 at the third installation stage 164. Step 206 represents the step of installing the flow control device 12 as a combined unit.

At the fourth installation/commissioning stage 166, the necessary testing and integration of the flow control device 12 are carried out. Step 207 represents a data processing step of allocating the flow control device identity within the HVAC system. Step 208 represents testing the flow control device 12 after installation. In addition to documenting correct operation, step 208 may also include recording, for the data model, characteristic parameters for the device 12 in its installed state. The information may be recorded with and/or associated with the birth-certificate. The information may optionally be stored in the remote data processing system 40 and/or in the actuator controller 32, in a similar manner to that described above.

Step 209 is an optional step if the HVAC system is newly installed in a building. A complete system test may be carried out to verify and document correct operation.

The second path 182 is similar to the first path 180, except that the actuator 20 and the damper (flow controller 16) are installed as separate new devices in the HVAC system rather than being "manufactured" as a unit. The second path 182 thus skips the second assembly stage 162. Instead, at the third installation stage 164, the damper is installed at step 210 followed by the actuator 20 at step 211.

Still referring to the second path 182, during the fourth installation/commissioning stage 166, testing and integration of the flow control device 12 is carried out in a similar manner to that already described. Step 212 (similar to step 207) represents a data processing step of allocating the flow control device identity within the HVAC system. Step 213 is an additional step of testing and documenting that the actuator 20 and damper function correctly together. Step 214 (similar to step 208) represents testing the flow control device 12 as part of the HVAC system. In addition to documenting correct operation, step 213 and/or 214 may also include recording, for the data model, characteristic parameters for the device 12 in its installed state. The information may be recorded with and/or associated with the birth-certificate. The information may optionally be stored in the remote data processing system 40 and/or in the actuator controller 32, in a similar manner to that described above.

The third path 184 is somewhat similar to the second path 182, except that the new actuator 20 is retrofitted to a damper (flow regulator 16) that is already installed in the HVAC system, e.g. to replace a previous defective actuator. The third path 184 thus passes directly to the third installation stage 164 in which the actuator 20 is installed with the existing damper at step 215 (similar to step 211). The third path 184 continues to the fourth integration/commissioning stage 166, at which processing is similar to the second path 182. Step 216 (similar to steps 207 and 212) represents a data processing step of allocating the flow control device identity within the HVAC system. Step 217 (similar to step 213) represents testing and documenting that the actuator 20 functions correctly with the damper. Step 218 (similar to steps 208 and 214) represents testing the flow control device 12 as part of the HVAC system. In addition to documenting correct operation, step 217 and/or 218 may also include recording, for the data model, characteristic parameters for the device 12 in its installed state. The information may be recorded with and/or associated with the birth-certificate. The information may optionally be stored in the remote data processing system 40 and/or in the actuator controller 32, in a similar manner to that described above.

Testing stage 168 represents later testing of the HVAC system 10, optionally particularly the flow control device 12. Testing may be carried out by regular checks, for example, to comply with local laws. Additionally or alternatively, testing may be carried out during regular maintenance. Additionally or alternatively, the control device 12 may monitor its operating performance as part of normal operation when the actuator 20 is commanded to move, and/or by the HVAC system controller 38 and/or the actuator controller 32 commanding periodic self-checks. Step 220 represents the actuator controller 32 generating commands to cause the actuator 20 to drive movement of the damper (flow regulator 16). Step 221 represents the controller 32 receiving signals from the sensors 34 (and optionally 36). Step 222 represents diagnosis of the flow control device 12 based on the sensor signals, to determine the presence (actual of forthcoming) of a malfunction, and to distinguish whether the malfunction is in the actuator 20 or the damper (flow regulator 16). Step 223 represents replacement and/or maintenance of the actuator 20 in the event of detecting actuator malfunction. Replacement would involve retrofitting a new actuator 20 as above.

The fourth integration/commissioning stage 166 and/or the fifth testing stage 168 may optionally be carried out with the assistance of the portable device 42. The portable device 42 may be a dedicated apparatus, or it may be a mobile computing device running application software. The portable device 42 may communicate with the actuator controller 32 by any local or wideare communication protocol. An example of a local protocol may, for example, be NFC (near field communication) with which the interface 144 and the mobile device 42 may both be equipped.

The portable device 42 may be configured to guide an operator through the process steps of the fourth stage 166 and/or the fifth stage 168, and to display results generated by the control device 12.

The portable device 42 may also be used to access reference and performance curves stored during the production stages of the actuator 20 and/or the damper (flow regulator 16). Additionally or alternatively, the portable device 42 may be used to access pending and/or archived error and/or warning messages. Additionally or alternatively, the portable device 42 may be used to access documentation referencing the control device 12 or one of its parts (e.g. actuator 20 and/or damper) such as specifications, datasheets or installation instructions.

The portable device 42 may also be used to access documentation referring to the installation site, such as a building plan. Location or position determination of portable unit 42 may be used to enhance the information provided (e.g. by indicating the location on the building plan).

Portable device 42 may also be used to control access to the control device 12.

It will be appreciated that the foregoing description is merely illustrative of preferred embodiments of the invention, and that many modifications and equivalents may be used within the scope and/or principles of the disclosure.

The invention claimed is:

1. A method of controlling an HVAC system comprising:

at least one flow regulator comprising an actuatable element for regulating fluid flow in a fluid path;

an electro-mechanical actuator associated with the flow regulator, to actuate the flow regulator, wherein the actuator comprises an electric motor driving a movable output member;

one or more sensors associated with the actuator, wherein the sensors are chosen from the group consisting of load sensors, force sensors, torque sensors, current sensors, voltage sensors, power sensors, speed sensors and position sensors;

a controller operatively connected with the actuator and the sensor(s);

wherein the method comprises the steps of:

i. actuating the flow regulator;

ii. receiving signals from the one or more sensors;

iii. determining an actual or forthcoming malfunction, based on the signals received in step ii.;

iv. indicating said actual or forthcoming malfunction to an operator of said HVAC system;

wherein step iv. comprises distinguishing between an actual or forthcoming malfunction of:

the actuator; and the flow regulator wherein in step iii. the actual or forthcoming malfunction is determined while taking into account as a corrective compensation one or more of:

a temperature at which the actuator is operating;

a temperature at which the flow regulator is operating; and history of at least one of actuator torques and actuator temperatures.

2. The method according to claim 1, wherein the actual or forthcoming malfunction of the actuator is selected from the group consisting of: a defective or worn out bearing for the output member; defective or worn out output gearing; defective actuator mounting; defective motor; defective motor bearing; defective connection to the flow regulator; non-attached connection to the flow regulator; defective return spring; defective supercapacitor for powering actuation to a predetermined position in the event of power loss; defective battery for powering actuation to a predetermined position in the event of power loss; defective electronic circuitry.

3. The method according to claim 1, wherein the HVAC system further comprises one or more sensors selected from the group consisting of: temperature sensors; humidity sensors; flow sensors; air speed sensors; air/fluid quality/pollution sensors; viscosity sensors; concentration sensors.

4. The method according to claim 1, wherein at least one of a cycle number, a count of direction changes, an aggregate operating time, an aggregate travel of the flow regulator; a cycle number, a count of direction changes, an aggregate operating time and an aggregate travel of the actuator is recorded.

5. The method according to claim 1, wherein in step iii. at least one of a reference load curve or current curve of the actuator per se without the flow regulator;

a reference curve associated with the flow regulator per se without the actuator; and a reference load curve or current curve of the actuator when operatively connected with the flow regulator is used to determine an actual or forthcoming malfunctioning.

6. The method according to claim 1, wherein in step iv. hysteresis of at least one of the actuator and a lever mechanism is used to distinguish between a malfunctioning of the actuator and the flow regulator.

7. A method of setting-up an HVAC system comprising:

at least one flow regulator comprising an actuatable element for regulating fluid flow in a fluid path;

an electro-mechanical actuator associated with the flow regulator, to actuate the flow regulator, wherein the actuator comprises an electric motor driving a movable output member;

one or more sensors associated with the actuator, wherein the sensors are chosen from the group consisting of load sensors, force sensors, torque sensors, current sensors, voltage sensors, power sensors, speed sensors and position sensors;

a controller operatively connected with the actuator and the sensor(s);

wherein the method comprises the steps of:

i. actuating the flow regulator;

ii. actuating the actuator per se, without the output member being operatively connected to the flow regulator;

iii. receiving signals from the one or more sensors during steps i. and ii.;

iv. determining an actual or forthcoming malfunctioning, based on the signals received in step iii.;

v. indicating said actual or forthcoming malfunctioning;

wherein step v. comprises distinguishing between an actual or forthcoming malfunctioning of:

the actuator; and the flow regulator.

8. The method according to claim 7, further comprising a step of:

providing user guidance as to how the malfunctioning can be overcome, based on the signals received in step iii.

9. The method according to claim 1, wherein the step of determining an actual or forthcoming malfunctioning comprises a step of diagnosing a forthcoming malfunction.

10. The method according to claim 1, wherein the step of determining an actual or forthcoming malfunction comprises a step of diagnosing an actual malfunction.

11. The method according to claim 1, wherein the step of determining an actual or forthcoming malfunction comprises a step of diagnosing both actual and forthcoming malfunctions.

12. The method according to claim 1, wherein the step of determining an actual or forthcoming malfunction comprises the steps of:

determining whether the signals received from the one or more sensors correspond to a forthcoming malfunction; and determining whether the signals received from the one or more sensors correspond to an actual malfunction.

13. The method according to claim 1, wherein the step of indicating the actual or forthcoming malfunction comprises a step of distinguishing between an actual malfunction and a forthcoming malfunction.

14. A method of controlling an HVAC system comprising:

at least one flow regulator comprising an actuatable element for regulating fluid flow in a fluid path;

an electro-mechanical actuator associated with the flow regulator, to actuate the flow regulator, wherein the actuator comprises an electric motor driving a movable output member;

one or more sensors associated with the actuator, wherein the sensors are chosen from the group consisting of load sensors, force sensors, torque sensors, current sensors, voltage sensors, power sensors, speed sensors and position sensors;

a controller operatively connected with the actuator and the sensor(s);

wherein the method comprises the steps of:

i. actuating the flow regulator;

ii. receiving signals from the one or more sensors;

iii. determining an actual or forthcoming malfunction, based on the signals received in step ii.;

iv. indicating said actual or forthcoming malfunction to an operator of said HVAC system;

wherein step iv. comprises distinguishing between an actual or forthcoming malfunction of:

the actuator; and the flow regulator wherein in step ii. at least one of:

at least one of the load profile and the current profile while actuation of the flow regulator is being released;

full-travel range information associated with an operational range of the flow regulator;

an integral calculated from at least one of a load profile and a current profile while the flow regulator is being actuated or actuation is being released;

a position of the output member at least one of at a maximum torque magnitude, at a maximum current magnitude, at a maximum magnitude of calculated derivative of load and at a maximum magnitude of calculated derivative of current;

a position of the output member in an at least one of open and closed position of the flow regulator;

a position of the output member at an extremity of a range of travel of the flow regulator;

a derivative of at least one of load and current when the flow actuator is close to an at least one of open and closed position; and a variance of at least one of load and current in a predetermined operating range is recorded.

15. A method of controlling an HVAC system comprising:

at least one flow regulator comprising an actuatable element for regulating fluid flow in a fluid path;

an electro-mechanical actuator associated with the flow regulator, to actuate the flow regulator, wherein the actuator comprises an electric motor driving a movable output member;

one or more sensors associated with the actuator, wherein the sensors are chosen from the group consisting of load sensors, force sensors, torque sensors, current sensors, voltage sensors, power sensors, speed sensors and position sensors;

a controller operatively connected with the actuator and the sensor(s);

wherein the method comprises the steps of:

i. actuating the flow regulator;

ii. receiving signals from the one or more sensors;

iii. determining an actual or forthcoming malfunction, based on the signals received in step ii.;

iv. indicating said actual or forthcoming malfunction to an operator of said HVAC system;

wherein step iv. comprises distinguishing between an actual or forthcoming malfunction of:

the actuator; and the flow regulator wherein the actual or forthcoming malfunction is determined in step iii. based on a data model, and the data model represents a variation of a characteristic during a cycle to open and close the flow regulator, and is divided into certain operating windows and each operating window represents a phase of operation.

16. The method according to claim 15, wherein information associated to the operating windows is derived from the data model as a key performance indicator.

17. The method according to claim 16, wherein the key performance indicator comprises at least one KPI parameter.

18. The method according to claim 16, wherein the key performance indicator comprises at least one KPI parameter selected from the group consisting of:

a maximum characteristic value associated with an operating window;

a peak characteristic value (86) associated with an operating window;

a difference (90) between a first characteristic value and a second characteristic value;

a standard deviation (92) of characteristic values in an operating window;

an integral (94) of a characteristic in an operating window;

full-travel range information (96) associated with an operational range of movement; and time information (98) associated with the time duration of an operating window.

19. The method according to claim 16, wherein the key performance indicator is compared to a historical key performance indicator.

20. The method according to claim 17, wherein one or more of:

a trend of a KPI parameter is used to determine an actual or forthcoming malfunction; and a combination of trends of KPI parameters is used to determine an actual or forthcoming malfunction.

* * * * *